US007304225B2

(12) United States Patent
Ricci

(10) Patent No.: US 7,304,225 B2
(45) Date of Patent: Dec. 4, 2007

(54) DEVICES FOR ALTERING AN ACOUSTIC PROPERTY OF STRINGED INSTRUMENTS, STRINGED INSTRUMENTS COMPRISING SAME, AND METHODS FOR ALTERING AN ACOUSTIC PROPERTY OF STRINGED INSTRUMENTS

(76) Inventor: Ruggiero Ricci, 1099 W. Chino Canyon Rd., Palm Springs, CA (US) 92264

( * ) Notice: Subject to any disclaimer, the term of this patent is extended or adjusted under 35 U.S.C. 154(b) by 111 days.

(21) Appl. No.: 10/818,088

(22) Filed: Apr. 5, 2004

(65) Prior Publication Data

US 2005/0217455 A1 Oct. 6, 2005

(51) Int. Cl.
*G10D 3/12* (2006.01)

(52) U.S. Cl. ..... 84/302

(58) Field of Classification Search ..... 84/312 R, 84/299–302, 307–309
See application file for complete search history.

(56) References Cited

U.S. PATENT DOCUMENTS

| | | | | |
|---|---|---|---|---|
| 440,882 | A | 11/1890 | Lorang et al. | |
| 576,606 | A | 2/1897 | Nichols | |
| 1,182,687 | A | 5/1916 | Kershner | |
| 2,199,612 | A * | 5/1940 | Born | 84/309 |
| 3,583,272 | A * | 6/1971 | Eurich | 84/267 |
| 4,149,442 | A * | 4/1979 | Boshco | 84/726 |
| 4,171,660 | A | 10/1979 | Kingsbury | |
| 4,334,455 | A | 6/1982 | Beecher | |
| 4,867,029 | A | 9/1989 | Lorenzen et al. | |
| 4,892,025 | A * | 1/1990 | Steinberger | 84/313 |
| 5,025,695 | A * | 6/1991 | Viel | 84/293 |
| 5,939,652 | A | 8/1999 | Jones | |
| 2004/0129127 | A1 * | 7/2004 | Mercer | 84/307 |

OTHER PUBLICATIONS

Wittner, GmbH, Advertisement for Tailpiece with an Adjustable Tailgut, *Strings,* Apr. 2003, p. 55.
Wittner GmbH, Advertisement for Tailpiece & Tailpiece Wire for ¾ Double Bass, *Strings,* Apr. 2003, p. 69.

* cited by examiner

*Primary Examiner*—Kimberly Lockett
(74) *Attorney, Agent, or Firm*—Brinks Hofer Gilson & Lione; Gregory H. Zayia

(57) ABSTRACT

Devices for altering an acoustic property of stringed instruments are described that include a tailpiece adjustment mechanism configured for rotating at least a portion of a tailpiece relative to a central axis of the stringed instrument, and/or for immobilizing at least a portion of a tailpiece such that at least a portion of vibrations of the tailpiece are restrained when the stringed instrument is played, and/or for transmitting at least a portion of vibrations produced in a tailpiece when the stringed instrument is played into a body portion of the stringed instrument. Stringed instruments containing such devices and methods for altering an acoustic property of stringed instruments are also described.

20 Claims, 8 Drawing Sheets

DEVICES FOR ALTERING AN ACOUSTIC PROPERTY OF STRINGED INSTRUMENTS, STRINGED INSTRUMENTS COMPRISING SAME, AND METHODS FOR ALTERING AN ACOUSTIC PROPERTY OF STRINGED INSTRUMENTS

FIELD OF THE INVENTION

The present invention relates to stringed musical instruments and, more particularly, to devices and methods for altering an acoustic property thereof. The present invention further relates to stringed musical instruments containing devices for altering an acoustic property thereof.

BACKGROUND

The acoustic properties of stringed musical instruments, and particularly, of wooden musical instruments played with a bow such as those in the violin family (e.g., violins, violas, cellos, and double basses) are influenced by a variety of factors. These factors include the quality of the instrument (e.g., skill of the maker, type and conditioning of the wood used, etc.), quality of the set-up (e.g., height and cut of the bridge, dimensions and fitting of the soundpost, dimensions and fitting of the bass board, angle of the fingerboard, etc.), physical condition of the instrument (e.g., presence and location of cracks, open seams, etc.), type of strings used (e.g., plain gut, metal, gut core encased in metal shell, synthetics, etc.), age and physical integrity of the strings, ambient conditions (e.g., temperature, humidity, acoustic properties of a concert hall, etc.), and the like.

The majority of the above-described factors cannot be readily controlled by the typical player, particularly in the moments immediately prior to or during a performance. Adjustments to the set-up of an instrument, repair of physical flaws in the instrument, replacement of old or damaged strings, and the like, typically require either the expertise of an experienced luthier and/or sufficient time on the part of the player. Oftentimes, however, a player is required to perform on an instrument exhibiting one or more unsatisfactory acoustic properties (e.g., pitch, tone, depth or volume of one or more strings, etc.) without having sufficient time, knowledge, skill, or resources to attempt to improve the objectionable acoustics. Moreover, it is oftentimes the case that a player strives to achieve a particular acoustic property during the course of a performance, such as the rapid change of pitch of a string that has gone out of tune or the strengthening in sound of a string that sounds weak, but is prohibited by the excessive time that would be required to correct the deficiency, which might exceed the time available to the player before his next musical entry.

The traditional mechanism available to a player for adjusting the pitch of the strings involves turning the pegs of the instrument. As shown in FIG. 1, which depicts a violin 2 for purposes of illustration, the first end of each of the four strings of the instrument is attached to (i.e., wound around) one of the four pegs in pegbox 4. Traditionally, the G-string 6 is attached to peg 8; the D-string 10 is attached to peg 12; the A-string 14 is attached to peg 16; and the E-string 18 is attached to peg 20. Each of the second ends of the four strings is inserted through and retained in a corresponding hole—22, 24, 26, and 28, respectively—in the tailpiece 30. The pitch of a string, which is determined by its tension and length, can be changed by turning the peg to which it is attached. Typically, an instrument cannot be tuned in this manner during the course of a performance inasmuch as the process is both time-consuming and disruptive. This tuning process is generally reserved for intervals between pieces and/or movements of a piece.

A second mechanism available to a player for adjusting the pitch of a string—typically the highest pitched string, which in the case of a violin is the E-string—involves the use of a fine tuner attached to the second end of the string at its corresponding hole in the tailpiece. As shown in FIG. 1, the second end 32 of the E-string 18 is connected to a fine tuner 34. Typically, the end of the string to be fine tuned is looped around a hook on the fine tuner 34, such that the turn of a thumbscrew on the fine tuner 34 changes the length of the E-string 18 and, therefore, its pitch. Although the use of a fine tuner may facilitate making small adjustments in pitch, it does not provide control over other acoustic properties of the instrument, such as tone, depth or strength of sound.

Stringed instruments in the violin family have been in use in a recognizable form since at least the sixteenth century. Thus, it is surprising that at present, one of the only mechanisms routinely available to players for adjusting the acoustic properties of an instrument is tuning the strings by the use of the pegs and/or a fine tuner as described above. Adjustments to other acoustic properties of the instrument remain largely outside the control of the typical player, requiring instead the expert attention of an experienced technician.

SUMMARY

The scope of the present invention is defined solely by the appended claims, and is not affected to any degree by the statements within this summary.

By way of introduction, a first device for altering an acoustic property of a stringed instrument that embodies features of the present invention includes a tailpiece adjustment mechanism configured for rotating at least a portion of a tailpiece relative to a central axis of the stringed instrument.

A second device for altering an acoustic property of a stringed instrument that embodies features of the present invention includes means for adjusting distance between a top surface of the stringed instrument and at least a portion of a tailpiece, such that a change in the distance causes a rotation of at least a portion of the tailpiece relative to a central axis of the stringed instrument.

A third device for altering an acoustic property of a stringed instrument that embodies features of the present invention includes a tailpiece adjustment mechanism configured for immobilizing at least a portion of a tailpiece such that at least a portion of vibrations of the tailpiece are restrained when the stringed instrument is played.

A fourth device for altering an acoustic property of a stringed instrument that embodies features of the present invention includes a tailpiece adjustment mechanism configured for transmitting at least a portion of vibrations produced in a tailpiece when the stringed instrument is played into a body portion of the stringed instrument.

A stringed instrument embodying features of the present invention includes a tailpiece adjustment mechanism configured for rotating at least a portion of a tailpiece relative to a central axis of the stringed instrument.

A first method for altering an acoustic property of a stringed instrument embodying features of the present invention includes: rotating at least a portion of a tailpiece relative to a central axis of the stringed instrument to produce a substantially constant altered acoustic property.

A second method for altering an acoustic property of a stringed instrument embodying features of the present invention includes: immobilizing at least a portion of a tailpiece such that at least a portion of vibrations of the tailpiece are restrained when the stringed instrument is played.

A third method for altering an acoustic property of a stringed instrument embodying features of the present invention includes: transmitting at least a portion of vibrations produced in a tailpiece when the stringed instrument is played into a body portion of the stringed instrument.

DETAILED DESCRIPTION

Devices and methods have been discovered and are described hereinbelow, which provide a player with a mechanism to alter at least one desired acoustic property of a stringed instrument. The devices and methods permit rapid and precise control over the adjustment and/or improvement of the acoustic properties of an existing instrument, which previously either (a) could not be altered, (b) required replacement of an unsatisfactory instrument with another exhibiting a desired acoustic property, (c) required careful and expert adjustment by an experienced luthier utilizing highly specialized tools, or the like.

The newly discovered devices and methods embodying features of the present invention provide tailpiece adjustment mechanisms whereby (a) at least a portion of the tailpiece of a stringed instrument may be rotated, thereby changing the pressure on one or more portions of the instrument and, in turn, altering one or more acoustic properties thereof, and/or whereby (b) at least a portion of the tailpiece of a stringed instrument may be immobilized such that at least a portion of vibrations of the tailpiece are restrained when the stringed instrument is played, thereby altering one or more acoustic properties thereof, and/or whereby (c) at least a portion of the vibrations of the tailpiece that are produced when the stringed instrument is played are transmitted into the body of the stringed instrument, thereby altering one or more acoustic properties thereof.

While neither desiring to be bound by any particular theory, nor intending to limit in any measure the scope of the appended claims or their equivalents, it is presently believed that the alteration of an acoustic property achieved in accordance with the present invention may be related to one or more of the following: change in pressure and/or tension of at least one string on the bridge of the instrument; change in effective length of one or more strings; change in pressure on the soundpost; change in pressure on the bass bar; reduction in movement and/or vibrations of the tailpiece; transmission of tailpiece vibrations into the body of the stringed instrument; and combinations thereof.

The acoustic properties that can be adjusted in accordance with the present invention are not limited to pitch—essentially the only adjustable parameter over which a player traditionally has control (e.g., by making adjustments to the pegs or fine tuner)—but also include other more elusive parameters, including but not limited to the tone of an instrument. Notwithstanding, in accordance with the present invention, the pitch of an instrument may be altered inasmuch as changing the string pressure and/or tension on the bridge by rotating at least a portion of the tailpiece may cause the effective length of one or more strings to change sufficiently relative to the length preceding rotation, such that a modified pitch will be produced when the affected string is played.

Figure 1:
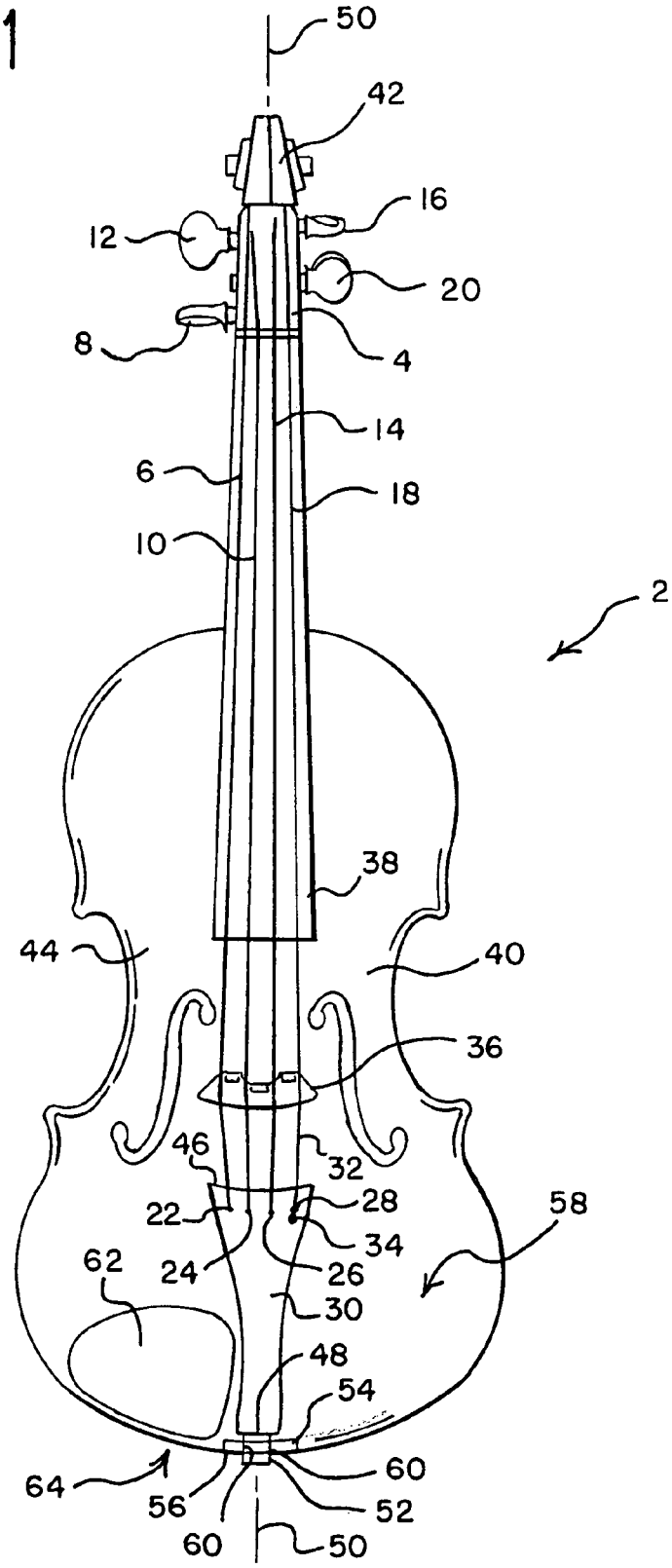
FIG. 1 shows a top view of a violin.

The bridge described above refers to an externally located, rounded wooden support that suspends the strings of an instrument over the surface of the soundboard (i.e., top surface or belly of an instrument). As shown in FIG. 1, the bridge 36 is positioned between the tailpiece 30 and the fingerboard 38 and held in place by pressure from strings 6, 10, 14, and 18, which are typically under tension. The pitch of the strings is sensitive to small changes in length and, more particularly, to changes in the length of a portion that is configured to vibrate. Traditionally, pitch adjustment has been accomplished by turning one or more of the pegs 8, 12, 16, and 20 and/or the fine tuner 34 shown in FIG. 1. However, it has been discovered in accordance with the present invention that by rotating at least a portion of the tailpiece relative to the central axis of an instrument, the pressure applied to the bridge and the effective length—correspondingly, the pitch—of at least one string may be altered and controlled, thereby providing a player with a convenient mechanism for changing the acoustic qualities of an instrument.

The soundpost described above refers to an internally located, cylindrical wooden rod fitted between the soundboard and the back of the instrument slightly to the rear of the bridge on the treble side. As shown in FIG. 1, the treble side 40 corresponds to the right half of the instrument when viewed from the top with the scroll 42 facing up. As described in *The Book of the Violin* (edited by Dominic Gill, Rizzoli, N.Y., 1984, page 35), the soundpost functions to conduct sound through the instrument to the back and to control the response of the instrument. The soundpost is a highly sensitive component, the manipulation of which alters the tone of an instrument dramatically. Traditionally, soundpost manipulation has been accomplished only by experienced luthiers utilizing specialized equipment. However, it has been discovered in accordance with the present invention that by rotating at least a portion of the tailpiece relative to the central axis of an instrument, the pressure applied to the soundpost can be altered and controlled, thereby providing a player with a convenient mechanism for changing the acoustic qualities of an instrument.

The bass bar described above refers to an internally located, longitudinal piece of wood that is fitted to the underside of the soundboard on the bass side of the instrument. As shown in FIG. 1, the bass side 44 corresponds to the left side of the instrument when viewed from the top with the scroll 42 facing up. As described in *The Book of the Violin* cited above (pages 24, 34-35), the bass bar functions to conduct sound transmitted through the bridge along the length of the instrument and, more particularly, to allow the entire soundboard area to be used for the production of bass tones. Unlike the soundpost described above, the bass bar is physically attached to the underside of the soundboard (e.g., with glue) and, therefore, is not typically adjustable after installation. However, the exact dimensions and precise fitting of the bass bar during installation, as well as the density of the wood used for the construction of the bass bar, dramatically affect the tone of an instrument. Thus, bass bar fitting has traditionally been accomplished only by experienced luthiers utilizing specialized equipment. However, it has been discovered in accordance with the present invention that by rotating at least a portion of the tailpiece relative to the central axis of an instrument, the pressure applied to the bass bar can be altered and controlled, thereby providing a player with a convenient mechanism for changing the acoustic qualities of an instrument.

An acoustic property of a stringed instrument in the violin family may be altered in accordance with the present invention by transferring pressure on the bridge from either the soundpost to the bass bar or vice versa. Typically, increased pressure applied to the bass side (and, therefore, to the bass bar) of an instrument in the violin family will cause at least one lower pitched string (e.g., G-string 6 and/or D-string 10 in FIG. 1) to sound more brilliant. Conversely, increased pressure applied to the treble side (and, therefore, to the soundpost) of an instrument in the violin family will cause at least one higher pitched string (e.g., E-string 18 and/or A-string 14 in FIG. 1) to sound more brilliant. In addition, the effective length of a string may be increased by applying pressure to the side of the instrument closest to that string.

Throughout this description and in the appended claims, the following definitions are to be understood:

The phrase "acoustic property" refers without limitation to any identifiable quality of an audible sound produced by an instrument, including but not limited to pitch (e.g., tuning, intonation, etc.), tone (e.g., warmth, brilliance, shrillness, modulation, etc.), timbre, sonority, duration of sound (e.g., reverberations, etc.), quality and/or type of overtones produced, depth and body of sound produced, strength and/or volume of sound produced, and the like, and combinations thereof. As used herein, the phrase "acoustic property" also encompasses the relative responsiveness of an instrument to a stimulus from a player. Moreover, as used herein, the phrase "acoustic property" also encompasses the production and/or minimization and/or elimination of "wolf tones," a phrase that refers to a type of fluttering-sounding vibration in a string that is sometimes produced, typically unintentionally, during the playing of a bowed instrument.

The phrase "stringed instrument" refers without limitation to any musical instrument comprising one or more strings, preferably though not necessarily to those played with a bow, and preferably though not necessarily, to acoustic (e.g., wooden) musical instruments in which the strings are suspended over a bridging element between two distal points on the instrument. Representative stringed instruments for use in accordance with the present invention include but are not limited to members and relatives of the violin family (e.g., violins, violas, cellos, double basses, etc.), banjos, mandolins, and the like.

The term "tailpiece" refers any device used to secure one end of at least one string in a musical instrument and, preferably, to devices used to secure the bottom end of at least one string. Presently preferred tailpieces for use in accordance with the present invention include but are not limited to those resembling the traditional substantially triangular shaped tailpiece 30 shown in FIG. 1. As used hereinbelow, the "plane of symmetry" referred to in reference to tailpieces corresponds to a plane that divides the tailpiece 30 into two substantially symmetrical halves starting lengthwise at the broad top edge 46 and continuing to the narrow bottom edge 48. Under "ambient conditions" (i.e., when the tailpiece is in a substantially horizontal configuration and has not yet been rotated), the plane of symmetry of the tailpiece is substantially perpendicular to the top surface of the instrument (assuming that the top surface of the instrument is flat rather than contoured). Tailpieces for use in accordance with the present invention may be crafted from any suitable material, including but not limited to wood, plastics, metals, and the like. It is to be understood that although some tailpieces, particularly those crafted of wood, may contain one or more ornamental carvings and/or one or more inlays or the like on their upper surface that might otherwise reduce the two-fold symmetry of the tailpiece, a "plane of symmetry" will still be assumed to exist for purposes of the description and claims below.

The phrase "tailpiece adjustment mechanism" refers to any adjustable member or combination of such members that either alone or in cooperation with one or more elements upon which they act (e.g., a tailpiece) may be manipulated to provide an alteration in an acoustic property of a stringed instrument. In addition, the phrase "tailpiece adjustment mechanism" refers to any device that either alone or in cooperation with one or more elements upon which it acts (e.g., a tailpiece) may be manipulated to provide such an alteration. By way of example, all manner of known devices that are capable of providing angular, height and/or other positional adjustments (e.g., lateral shifts) of the element to be adjusted, and equivalents thereof, may be adapted for use in accordance with the present invention.

The term "rotating" refers to the application of any type of force or pressure to any portion of a tailpiece—such as the type of bearing force or pressure introduced by the adjustment of an adjustable member and/or by the repositioning of a tailpiece adjustment mechanism—that acts to turn the affected portion around the central axis of the stringed instrument. The forces and/or pressure applied may be parallel and/or perpendicular and/or transverse to the plane of symmetry of the tailpiece. It is to be understood that the magnitude of rotation-induced changes described herein are not restricted, and may include very small differences, the results of which may be more readily detectable aurally than visually.

The term "rotation" refers to the receipt of any type of force or pressure by any portion of a tailpiece that acts to turn the affected portion about the central axis of the stringed instrument. As described above, the magnitude of the rotation may or may not result in any readily observable visual change in the position or appearance of any portion of the tailpiece. Moreover, depending on the flexibility of the material used to construct a tailpiece and also on the placement of the tailpiece adjustment mechanism with respect to the tailpiece, an adjustment that increases or decreases a distance between any portion of the tailpiece and the top surface of a stringed instrument on one side of the tailpiece may not significantly affect (i.e., either increase or decrease) the distance between the top surface of the stringed instrument and any portion of the tailpiece on the opposite side of the tailpiece. Notwithstanding, such an adjustment will generally suffice to alter an acoustic property of the stringed instrument and constitutes a "rotation" in accordance with the present invention. In addition, an adjustment that increases or decreases a first distance between the top surface of a stringed instrument and any portion of the tailpiece on a first side of the tailpiece may simultaneously increase or decrease a second distance between the top surface of the stringed instrument and at least one portion of the tailpiece on the opposite side of the tailpiece. Such an adjustment will generally suffice to alter an acoustic property of the stringed instrument and also constitutes a "rotation" in accordance with the present invention.

The term "immobilizing" refers to constraining or limiting at least a portion of the vibrations of a tailpiece when a stringed instrument containing the tailpiece is played. The degree to which these vibrations are reduced is not restricted, and includes both small and large reductions. Accordingly, as used herein, the term "immobilizing" and the related term "immobilization" encompass all manner and degrees of restriction (e.g., ranging from slightly reduced mobility through absolute immobility).

The phrase "effective length," used herein in reference to strings refers to the portion of a string that contributes to its observed pitch.

The phrase "protecting member" refers to any element interposed between the surface of an instrument and an element to be placed thereupon, which minimizes or prevents damage (e.g., scratching, denting, discoloration, etc.) to the surface of the instrument. A representative "protecting member" for use in accordance with the present invention, which is particularly preferred for use with wooden instruments, includes but is not limited to a layer of cork.

The phrase "central axis of an instrument" refers to an axis of symmetry that runs lengthwise through the instrument. By way of example, as shown in FIG. 1, the central axis 50 of violin 2 starts at the scroll 42 and continues through to the bottom end button 52, thus dividing the violin 2 into two substantially symmetrical halves.

The term "saddle" refers to an element installed into a bottom edge on the top surface of an instrument to protect the surface of the instrument from damage caused by portions of the tailpiece. The top surface of the saddle may be flush with the top surface (i.e., table) of the instrument or, more typically, slightly raised. By way of example, as shown in FIG. 1, a saddle 54 is installed into the bottom edge 56 of violin 2 to protect the top surface 58 from damage caused by contact with and/or rubbing from a tailgut 60 (i.e., a flexible material such as gut, metal, nylon or the like). Saddles for use in accordance with the present invention may be crafted from any suitable material, including but not limited to wood, dentine (e.g., ivory), plastics, metals, and the like. It is presently preferred that at least a portion of the saddle, particularly the portion installed into the edge of the instrument, be made of either wood, with hard wood such as ebony being presently preferred, or ivory.

The phrase "end button" refers to a short peg inserted into the lower bout of an instrument, whereby the tailpiece may be held in a fixed position. By way of illustration, as shown in FIG. 1, an end button 52 extends from the lower bout 64 of violin 2 and, in combination with the tailgut 60, holds the tailpiece 30 in a fixed position. As used herein, the phrase "end button" is used synonymously with the term "endpin," which refers to a counterpart element used in larger stringed instruments, such as in cellos and double basses. An endpin typically includes a sliding metal rod positioned in a wooden hole in the instrument, such that when the rod is extended, a distance may be maintained between the bottom of the instrument and the ground.

The term "slot" refers to any geometric pattern on the end of a fastener (e.g., a screw) that is configured to engage a complementary geometric pattern on an adjusting implement. As used herein, this term includes but is not limited to the geometric pattern contained on slot-head screws, Phillips-head screws, and Allen-head screws.

The term "prism" refers to a solid figure containing two congruent parallel faces and a plurality of parallel edges that connect corresponding vertices of the parallel faces.

The term "quadrilateral prism" refers to a prism in which the two congruent parallel faces correspond to four-sided figures. Preferably, the four-sided figures contain two parallel and two non-parallel sides. Presently preferred four-sided figures include trapezoids. As used herein, one or more sides of the four-sided figure may be curved. If curvature is included, it is presently preferred that the curvature is located at one or both of the non-parallel sides of the four-sided figure.

The phrase "trilateral prism" refers to a prism in which the two congruent parallel faces correspond to three-sided figures. Presently preferred three-sided figures include triangles (e.g., scalene, isosceles, equilateral), with scalene triangles being presently preferred triangles. As used herein, one or more sides of the three-sided figure may be curved.

A presently preferred device embodying features of the present invention includes a tailpiece adjustment mechanism configured for adjusting a distance between a top surface of a stringed instrument and at least a portion of a tailpiece, such that a change in the distance causes a rotation of at least a portion of the tailpiece relative to a central axis of the stringed instrument.

A first series of tailpiece adjustment mechanisms in accordance with the present invention preferably comprise at least one adjustable member connected to (i.e., in contact with) the tailpiece. The adjustable member may be physically attached to the tailpiece (e.g., by applying an adhesive to the contacting surfaces, forming both the tailpiece and the adjustable member from a contiguous piece of material or the like), incorporated through an opening in the tailpiece (e.g., by providing a hole in the tailpiece, such that the hole is configured to receive a threaded screw), detachably inserted underneath the tailpiece (e.g., by wedging the adjustable member and/or the tailpiece adjustment mechanism between the top surface of the instrument and the bottom surface of the tailpiece) or the like.

A second series of tailpiece adjustment mechanisms in accordance with the present invention are themselves adjustable and may be repositioned with respect to a tailpiece in order to achieve a desired degree of rotation of the tailpiece. Such tailpiece adjustment mechanisms may or may not include one or more adjustable members.

All manner of adjustable members are contemplated for use in accordance with the present invention. By way of illustration only, representative adjustable members include but are not limited to screws, the tongue and/or groove of a tongue-and-groove assembly, the inner and/or outer tube of a telescoping tube assembly, the extendible load-bearing plate of a screw jack, and the like, and combinations thereof.

Presently preferred adjustable members for use in accordance with the present invention include one or a plurality of (i.e., at least two) adjustable screws. Screws are presently preferred adjustable members in view of their low cost, simple design, ease of use, and availability in many different circumferences, thread types, and lengths. In addition, slight adjustments to a screw, and particularly to a finely threaded screw, may allow subtle changes to be made to a parameter, which changes might not otherwise be accessible using an adjustable member having a discrete number of separate adjustable states as opposed to a continuum or near continuum of adjustable states.

Tailpiece adjustment mechanisms embodying features of the present invention may be symmetrical or unsymmetrical with respect to the tailpiece. Moreover, tailpiece adjustment mechanisms embodying features of the present invention may be located at one or at a plurality of positions on, in, under, or adjacent to the tailpiece. Preferably, the tailpiece adjustment mechanism is located near at least one side of the plane of symmetry of the tailpiece. Furthermore, a plurality of tailpiece adjustment mechanisms embodying features of the present invention may be simultaneously included at a plurality of positions on, in, under, and/or adjacent to the tailpiece to provide a user with multiple controls over one or more acoustic properties to be altered. In such cases, the tailpiece adjustment mechanisms may be of the same or different types (e.g., combinations of several of the representative embodiments described below).

Although desirable in certain embodiments described below, it is generally unnecessary to provide a tailpiece adjustment mechanism and/or a portion thereof at both symmetrical halves of the tailpiece. It has been discovered that certain acoustic properties of an instrument can be altered satisfactorily if the adjustment mechanism and/or an adjustable portion thereof (e.g., a screw) is utilized on only one side of the tailpiece rather than on both sides. In such instances, it is presently preferred that the adjustment mechanism be placed so that the weaker side of the instrument may be strengthened thereby. For example, if the weaker side of a particular violin corresponds to its G-string side or bass side, a tailpiece adjustment mechanism embodying features of the present invention may be configured to increase the pressure on the G-string side. By way of illustration, one such tailpiece adjustment mechanism may be included under the tailpiece on the treble side of the violin and configured to raise at least a portion of the treble side of the tailpiece, thereby causing a portion of the tailpiece to rotate counterclockwise (as viewed from the top of the violin with the scroll facing up), such that increased pressure is applied to the bass side of the violin.

Presently preferred embodiments in accordance with the present invention will now be described in reference to the appended drawings. For purposes of illustration, the stringed instrument depicted in several of these drawings is a violin. It is to be understood, however, that a violin is merely one representative example of a stringed instrument that may be used in accordance with and/or that embodies features of the present invention. In addition, it is to be understood that elements and features of the various representative embodiments described below may be combined in different ways to produce new embodiments that likewise fall within the scope of the present invention. Furthermore, it is to be understood that designations such as "first" and "second" used herein to identify individual members of a pair of similar elements (e.g., first screw, second screw, first side of tailpiece, second side of tailpiece, etc.) may be reversed. For example, if a screw positioned on the treble side of an instrument is identified in a drawing as being a "first screw" and an optional screw positioned on the bass side of the same instrument is identified in the same drawing as being a "second screw," an embodiment described as containing only a first screw but not a second screw includes both the configuration in which the first screw is positioned on the treble side of the instrument as well as the configuration in which the first screw is positioned on the bass side of the instrument. The drawings and the description below have been provided solely by way of illustration, and are not intended to limit the scope of the appended claims or their equivalents.

A first series of presently preferred devices embodying features of the present invention includes a tailpiece adjustment mechanism at least a portion of which is configured for placement underneath the tailpiece and, preferably, for placement under one or both sides of the plane of symmetry of the tailpiece. Representative devices in this first series include (a) embodiments in which a conventional tailpiece (such as tailpiece 30 shown in FIG. 1) are modified to accommodate a tailpiece adjustment mechanism embodying features of the present invention (e.g., FIGS. 2-8), (b) embodiments in which a conventional tailpiece (such as tailpiece 30 shown in FIG. 1) and a conventional saddle (such as saddle 54 shown in FIG. 1) are redesigned or modified to accommodate a tailpiece adjustment mechanism embodying features of the present invention (e.g., FIGS. 9-13), and (c) devices that may be used directly with an existing conventional tailpiece (such as tailpiece 30 shown in FIG. 1) (e.g., FIGS. 14-20 and 23-30). A second series of presently preferred devices embodying features of the present invention includes a tailpiece adjustment mechanism at least a portion of which is configured for placement adjacent to a bottom edge of the tailpiece. Representative devices in this second series include embodiments in which a conventional saddle (e.g., saddle 54 in FIG. 1) is redesigned or modified to accommodate a tailpiece adjustment mechanism embodying features of the present invention (e.g., FIGS. 21-22).

Figure 2:
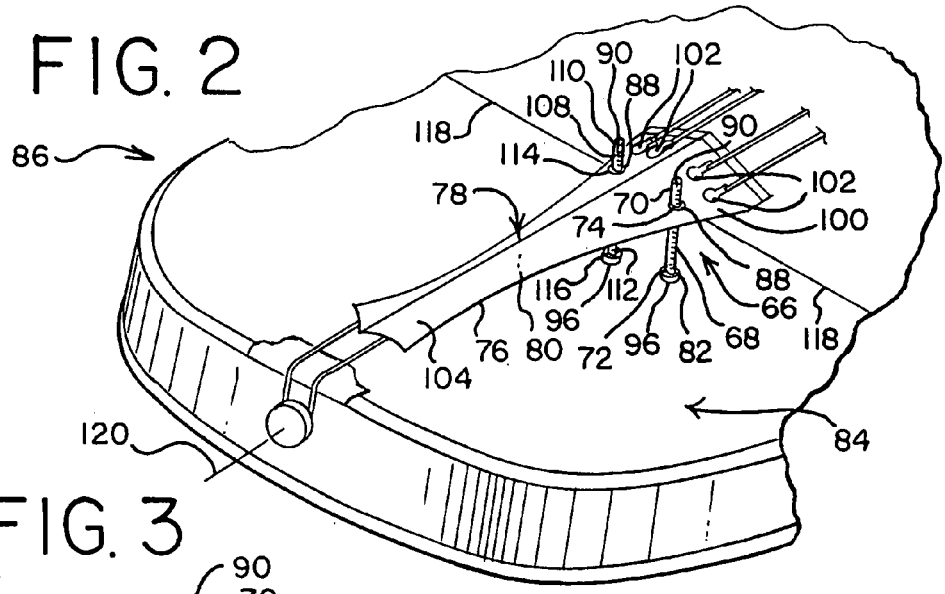
FIG. 2 shows a perspective view of a first device embodying features of the present invention shown in context with a portion of a representative stringed instrument.

A first presently preferred embodiment in accordance with the present invention is shown in FIGS. 2-5. As shown in FIG. 2, the tailpiece adjustment mechanism 66 includes a first screw 68 having a first end 70 and a second end 72. The first screw 68 is threaded through a first hole 74 in the tailpiece 76, such that the first end 70 extends over a top surface 78 of the tailpiece 76 and the second end 72 extends through a bottom surface 80 of the tailpiece 76. The second end 72 is configured to contact a first bearing surface 82 adjacent to the top surface 84 of the stringed instrument 86.

Optionally, a bushing 88, preferably made of metal, may be incorporated into the first hole 74 of tailpiece 76 in order to protect the threads of the first screw 68 and to minimize or prevent damage to and/or deformation of the tailpiece 76. If the tailpiece 76 is crafted from metal or plastic, it may be desirable to thread the first screw 68 directly through the first hole 74 without the use of a bushing 88. However, if the tailpiece 76 is crafted from wood (e.g., ebony, rosewood, boxwood, etc.), it is presently preferred that a bushing 88 be used.

Figure 3:
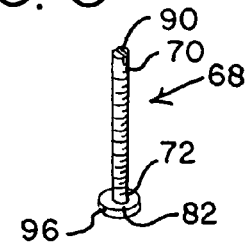
FIG. 3 shows a detailed view of a first screw embodying features of the present invention, which comprises a slot in the first end thereof.

As shown in FIGS. 2 and 3, the first end 70 of first screw 68 may include a slot 90 configured to receive an adjusting implement such as a screwdriver head (not shown), whereby the height of first screw 68 may be adjusted. In an alternative configuration, shown in FIG. 4, the first end 70 of first screw 68 may include a head 92 configured to be turned manually (e.g., by the thumb and forefinger of an operator). In this alternative configuration, shown in FIG. 4, it is presently preferred that the head 92 include at least one milled edge 94 in order to facilitate turning by an operator. When it is desirable to employ a device embodying features of the present invention during the course of a performance, it is presently preferred that the first screw 68 include a head 92 so that a player may quickly make adjustments without requiring the use of an implement.

Figure 4:
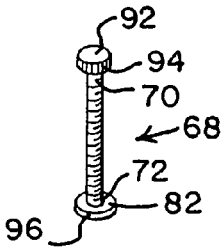
FIG. 4 shows a detailed view of a second screw embodying features of the present invention, which comprises a head on the first end thereof.

As shown in FIGS. 2-4, it is presently preferred that a protecting member 96 be interposed between the first bearing surface 82 and the top surface 84 of the stringed instrument 86 in order to prevent damage (e.g., scratching, denting, gouging, etc.) to the top surface 84. The use of a protecting member 96 is particularly preferred when the top surface 84 of stringed instrument 86 is made of wood. All manner of materials that are substantially compatible with the top surface 84 have been contemplated for use as a protecting member 96 including but not limited to one or more layers of cork, fabric (e.g., silk, cotton, wool, linen, felt, etc.), and the like, and combinations thereof. A layer of cork is a particularly preferred protecting member at present.

In addition, all manner of shapes and geometries are contemplated for the protecting member 96. Preferably, the design of protecting member 96 is complementary to the configuration of the first bearing surface 82. For example, as shown in FIGS. 2-4, the first bearing surface 82 is provided as a substantially circular foot, and the protecting member 96 is provided as a substantially circular pad having a circumference approximating that of the first bearing surface 82. In an alternative configuration, shown in FIG. 5, the first bearing surface 82 is provided as a curved base plate 98 and the protecting member 96 is provided as a curved layer approximating the dimensions of the first bearing surface 82 superimposed thereon. Since the top surface 84 of the stringed instrument 86 is typically not completely flat, it is presently preferred that at least one and, more preferably, both of the first bearing surface 82 and the protecting member 96 either be themselves contoured so as to substantially match the contour at the portion of the top surface 84 where they are to be placed and/or be sufficiently flexible (e.g., by manufacturing the first bearing surface 82 from a sufficiently flexible plastic and by adhering a flexible layer of cork thereto) so as to bend to match this contour.

The tailpiece adjustment mechanism 66 shown in FIG. 2 is positioned in a top portion 100 of the tailpiece 76 in proximity to the string receiving holes 102 and to the soundpost (not shown). However, it is to be understood that the tailpiece adjustment mechanism may be located elsewhere in the tailpiece, including but not limited to a bottom portion 104, as further described below.

In certain configurations of the first presently preferred embodiment depicted in FIG. 2, only one adjustable screw is included in the tailpiece adjustment mechanism 66. In such configurations, it is presently preferred that the first screw 68 be positioned on either side of the plane of symmetry of the tailpiece. For stringed instruments in the violin family, the positioning of the first screw 68 is preferably determined according to which of the treble side and the bass side a player seeks to strengthen.

In alternative configurations of the first presently preferred embodiment depicted in FIG. 2, the tailpiece adjustment mechanism 66 further includes a second screw 108, which is preferably positioned on a side of the plane of symmetry opposite to the side containing the first screw 68. It is to be understood that additional screws may also be incorporated into tailpiece adjustment mechanisms embodying features of the present invention, and they may be located in positions throughout the tailpiece 76.

As shown in FIG. 2, the second screw 108 is substantially identical to the first screw 68 and includes a first end 110 and a second end 112. The second screw 108 is threaded through a second hole 114 in the tailpiece 76, such that the first end 110 extends over the top surface 78 of the tailpiece 76 and the second end 112 extends through the bottom surface 80 of the tailpiece 76. The second end 112 is configured to contact a second bearing surface 116 adjacent to the top surface 84 of the stringed instrument 86.

All of the preceding description relating to the first screw 68 applies equally to the second screw 108. By way of illustration, the second hole 114 of tailpiece 76 may be fitted with an optional bushing 88. In addition, the first end 110 of second screw 108 may include a slot 90 configured to receive an implement, as shown in FIG. 2, or a head 92 with an optional milled edge 94 configured to be turned manually. Furthermore, a protecting member 96 is preferably interposed between the second bearing surface 116 and the top surface 84 of the stringed instrument 86. Moreover, it is presently preferred that at least one and, more preferably, both of the second bearing surface 116 and the protecting member 96 either be themselves contoured so as to substantially match the contour at the portion of the top surface 84 where they are to be placed and/or be sufficiently flexible so as to bend to match this contour.

For configurations of the first presently preferred embodiment depicted in FIG. 2 in which the tailpiece adjustment mechanism 66 includes first and second screws 68 and 108, respectively, it is presently preferred that the first screw 68 and the second screw 108 be positioned along an axis 118 substantially perpendicular to the central axis 120 of the stringed instrument 86, preferably either in the top portion 100 or the bottom portion 104 of the tailpiece 76. When the first screw 68 and the second screw 108 both lie along an axis 118, it may be desirable to utilize a curved base plate 98, shown in FIG. 5, which may provide both the first and second bearing surfaces 82 and 116, respectively.

To alter an acoustic property of a stringed instrument using the tailpiece adjustment mechanism 66 shown in FIG. 2, one or both of first screw 68 and second screw 108 is turned to either raise or lower at least a portion of either side of the tailpiece 76, which in turn may alter the pressure on one or more of the bridge, soundpost, and bass bar, and/or change the effective length of one or more strings.

Figure 6:
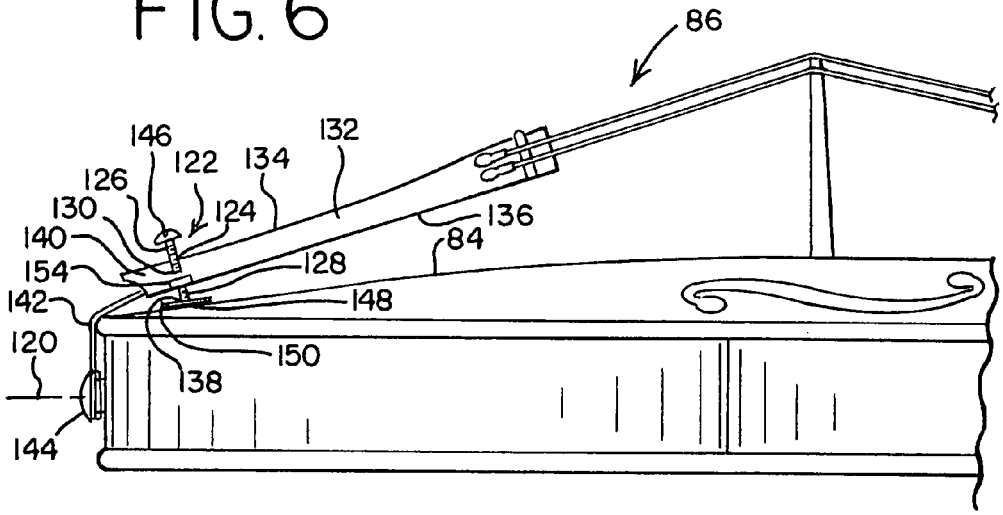
FIG. 6 shows a side view of a second device embodying features of the present invention shown in context with a portion of a representative stringed instrument.
Figure 7:
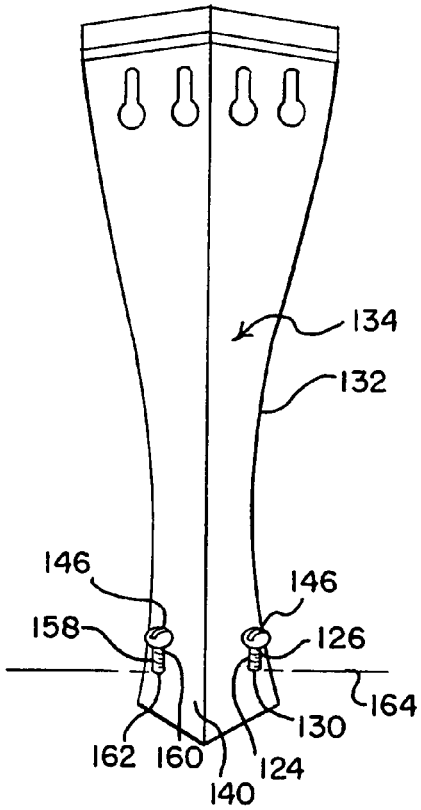
FIG. 7 shows a top view of the device shown in FIG. 6.
Figure 8:
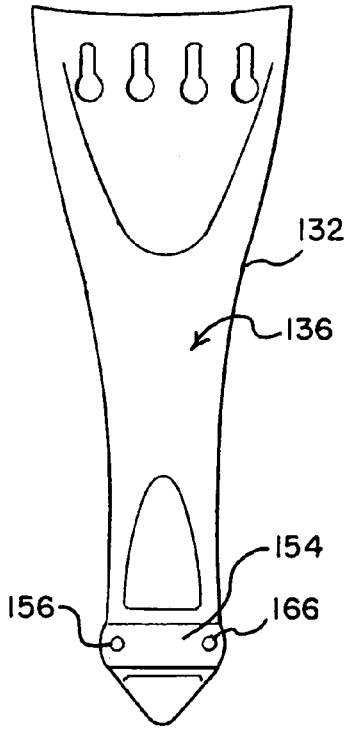
FIG. 8 shows a bottom view of the device shown in FIG. 6.

A second presently preferred embodiment in accordance with the present invention is shown in FIGS. 6-8. As shown in FIG. 6, the tailpiece adjustment mechanism 122 includes a first screw 124 having a first end 126 and a second end 128. The first screw 124 is threaded through a first hole 130 in the tailpiece 132, such that the first end 126 extends over a top surface 134 of the tailpiece 132 and the second end 128 extends through a bottom surface 136 of the tailpiece 132. The second end 128 is configured to contact a first bearing surface 138 adjacent to the top surface 84 of the stringed instrument 86. The tailpiece adjustment mechanism 122 shown in FIGS. 6-8 is positioned in a bottom portion 140 of the tailpiece 132 in proximity to a bottom edge 142 of the stringed instrument 86 and to end button 144.

All of the preceding description relating to the first presently preferred embodiment described above and shown in FIGS. 2-5 applies equally to the second presently preferred embodiment shown in FIGS. 6-8. By way of illustration, the first hole 130 of tailpiece 132 may be fitted with an optional bushing (not shown). In addition, the first end 126 of first screw 124 may include a slot 146, as shown in FIGS. 6 and 7, or a head with an optional milled edge (not shown). Furthermore, a protecting member 148 (e.g., a layer of cork) is preferably interposed between the first bearing surface 138 and the top surface 84 of the stringed instrument 86. Moreover, it is presently preferred that at least one and, more preferably, both of the first bearing surface 138 and the protecting member 148 either be themselves contoured so as to substantially match the contour at the portion of the top surface 84 where they are to be placed and/or be sufficiently flexible so as to bend to match this contour.

Figure 5:
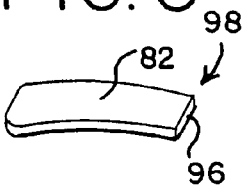
FIG. 5 shows a perspective view of a curved base plate embodying features of the present invention.

As shown in FIG. 6, it is presently preferred that the first bearing surface 138 be provided by a curved base plate 150 analogous to that shown in FIG. 5, which includes a protective layer of cork on its underside. In addition, it is preferred that the curved base plate 150 be contoured to the top surface 84 of the stringed instrument 86.

As described above, the use of a bushing is presently preferred particularly in the case of wooden tailpieces. An alternative configuration that may be used in place of or in addition to a bushing is shown in FIG. 8. A portion of the bottom surface 136 of tailpiece 132 is recessed (i.e., mortised) to receive a plate 154 therein. Preferably, the plate 154 is metallic (e.g., brass) although other materials, particularly hardened materials such as various polymers, are also contemplated for use. The metal plate 154 includes a first hole 156 substantially aligned with the first hole 130 in tailpiece 132, such that the second end 128 of the first screw 124 is configured to extend through the metal plate 156.

In certain configurations of the second presently preferred embodiment depicted in FIGS. 6-8, only one adjustable screw is included in the tailpiece adjustment mechanism 122. In such configurations, it is presently preferred that the first screw 124 be positioned on either side of the plane of symmetry of the tailpiece. For stringed instruments in the violin family, the positioning of the first screw 124 is preferably determined according to which of the treble side and the bass side a player seeks to strengthen.

In alternative configurations of the second presently preferred embodiment depicted in FIGS. 6-8, the tailpiece adjustment mechanism 122 further includes a second screw 158, which is preferably positioned in the bottom portion 140 of tailpiece 132, on a side of the plane of symmetry opposite to the side containing the first screw 124. In addition, it is presently preferred that the first screw 124 and the second screw 158 be positioned along an axis 164 substantially perpendicular to the central axis 120 of stringed instrument 86.

As shown in FIG. 7, the second screw 158 is substantially identical to the first screw 124 and includes a first end 160 and a second end (not shown). The second screw 158 is threaded through a second hole 162 in the tailpiece 132, such that the first end 160 extends over the top surface 134 of tailpiece 132 and the second end (not shown) extends through the bottom surface 136 of tailpiece 132. For configurations of the second presently preferred embodiment depicted in FIGS. 6-8 in which the tailpiece adjustment mechanism 122 includes first and second screws 124 and 158, respectively, the metal plate 154 includes a second hole 166, shown in FIG. 8, which is substantially aligned with the second hole 162 in tailpiece 132, such that the second end (not shown) of the second screw 158 is configured to extend through the metal plate 154.

The second end (not shown) of the second screw 158 is configured to contact a second bearing surface (not shown) adjacent to the top surface 84 of the stringed instrument 86, which second bearing surface is preferably provided by curved base plate 150 (described above in connection with the first screw 124). In such a configuration, curved base plate 150 provides both the first bearing surface 138 and the second bearing surface (not shown).

All of the preceding description relating to the first screw 124 applies equally to the second screw 158. By way of illustration, the second hole 162 of tailpiece 132 may be fitted with an optional bushing (not shown). In addition, the first end 160 of second screw 158 may include a slot 146 configured to receive an implement, as shown in FIG. 7, or a head with an optional milled edge (not shown). Furthermore, a protecting member 148 is preferably interposed between the second bearing surface (not shown) and the top surface 84 of stringed instrument 86. In a presently preferred configuration, both the first bearing surface 138 and the second bearing surface are contiguous and provided by the curved base plate 150. In such a configuration, the first bearing surface 138 and the second bearing surface share a common protecting member 148, which preferably corresponds to a layer of cork provided on a bottom surface of curved base plate 150.

To alter an acoustic property of a stringed instrument using the tailpiece adjustment mechanism 122 shown in FIG. 6, one or both of first screw 124 and second screw 158 is turned to either raise or lower at least a portion of either side of tailpiece 132, which in turn may alter the pressure on one or more of the bridge, soundpost, and bass bar, and/or change the effective length of one or more strings.

Figure 9:
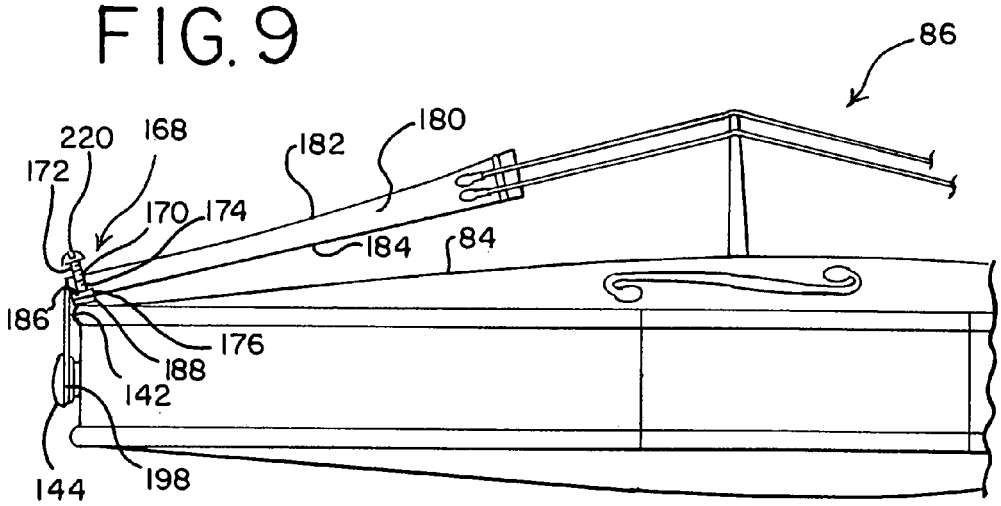
FIG. 9 shows a side view of a third device embodying features of the present invention shown in context with a portion of a representative stringed instrument.
Figure 10:
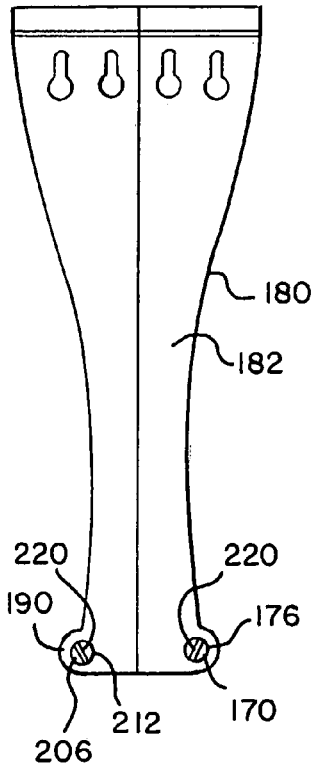
FIG. 10 shows a top view of the device shown in FIG. 9.
Figure 11:
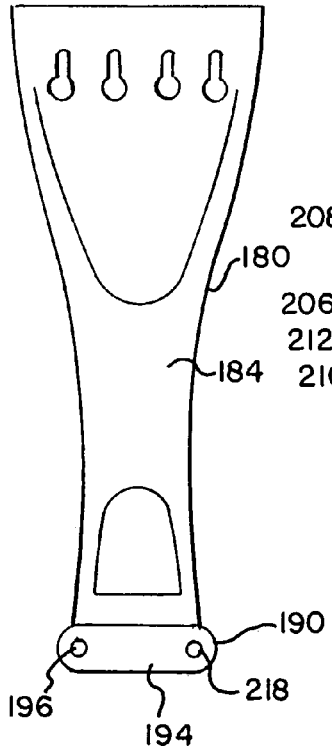
FIG. 11 shows a bottom view of the device shown in FIG. 9.
Figure 12:
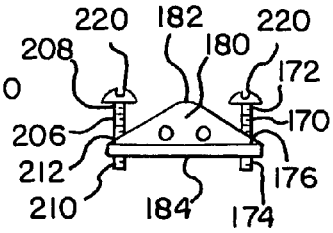
FIG. 12 shows an end view of the device shown in FIG. 9.

A third presently preferred embodiment in accordance with the present invention is shown in FIGS. 9-13. As shown in FIGS. 9 and 12, the tailpiece adjustment mechanism 168 includes a first screw 170 having a first end 172 and a second end 174. The first screw 170 is threaded through a first hole 176 in the tailpiece 180, such that the first end 172 extends over a top surface 182 of the tailpiece 180 and the second end 174 extends through a bottom surface 184 of the tailpiece 180. The second end 174 is configured to contact a first bearing surface 186 adjacent to the top surface 84 of the stringed instrument 86.

As shown in FIG. 9, the tailpiece adjustment mechanism 168 is positioned substantially over a saddle 188 of stringed instrument 86. As shown in FIGS. 10 and 11, the tailpiece 180 includes a flange 190 along a bottom edge thereof, which flange 190 comprises the first hole 176 and is configured for contacting the saddle 188 directly. The first bearing surface 186 is provided by an upper surface of the saddle 188.

As shown in FIGS. 11 and 12, the bottom surface 184 of tailpiece 180 preferably includes a plate 194 that is either affixed directly to (e.g., by adhesive) or mortised within flange 190. Preferably, the plate 194 is metallic (e.g., brass) although other materials, particularly hardened materials such as various polymers, are contemplated for use. The metal plate 194 includes a first hole 196 substantially aligned with the first hole 176 in tailpiece 180, such that the second end 174 of the first screw 170 is configured to extend through the metal plate 194.

As shown in FIG. 9, the third presently preferred embodiment maintains a direct contact between the tailpiece 180 and stringed instrument 86, thereby minimizing or eliminating the suspension aspect of the tailgut 198 used to secure tailpiece 180 to end button 144. Although the tailpiece 180 may be used in combination with a conventional saddle, such as saddle 54 shown in FIG. 1, the bearing forces exerted by the second end 174 of first screw 170 are likely to cause damage to the saddle, which typically is crafted from a wood (e.g., ebony) or from ivory. Accordingly, it is presently preferred that a modified saddle 188 be employed instead.

Figure 13:
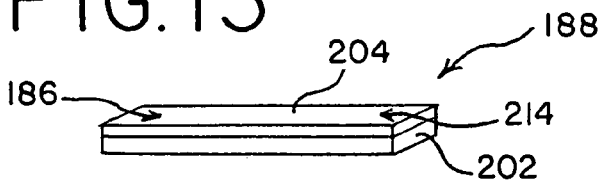
FIG. 13 shows a perspective view of a first saddle embodying features of the present invention for use with the device shown in FIG. 9.

As shown in FIG. 13, the modified saddle 188 includes a wood layer 202 compatible with the stringed instrument 86 (e.g., ebony, boxwood, rosewood, etc. or the ebony-like material ivory) and suitable for installation in the bottom edge 142 thereof, and a metal layer 204 (e.g., brass) superimposed on the wood layer 202, which provides the first bearing surface 186. Preferably, the metal layer 204 is affixed to the wood layer 202 (e.g., with an adhesive).

In certain configurations of the third presently preferred embodiment depicted in FIGS. 9-13, only one adjustable screw is included in the tailpiece adjustment mechanism 168. In such configurations, the first screw 170 may be positioned on either side of the plane of symmetry of the tailpiece. For stringed instruments in the violin family, the positioning of the first screw 170 is preferably determined according to which of the treble side and the bass side a player seeks to strengthen.

In alternative configurations of the third presently preferred embodiment depicted in FIGS. 9-13, the tailpiece adjustment mechanism 168 further includes a second screw 206 that is positioned on a side of the plane of symmetry opposite to the side containing the first screw 170.

As shown in FIGS. 10 and 12, the second screw 206 is substantially identical to the first screw 170 and includes a first end 208 and a second end 210. The second screw 206 is threaded through a second hole 212 in the tailpiece 180, such that the first end 208 extends over a top surface 182 of tailpiece 180 and the second end 210 extends through a bottom surface 184 of tailpiece 180. The second end 210 is configured to contact a second bearing surface 214 adjacent to the top surface 84 of the stringed instrument 86.

For configurations of the third presently preferred embodiment depicted in FIGS. 9-13 in which the tailpiece adjustment mechanism 168 includes first and second screws 170 and 206, respectively, both the first bearing surface 186 and the second bearing surface 214 are provided by an upper surface of the saddle 188, as shown in FIG. 13. In such configurations, the flange 190 comprises the second hole 212. In addition, for embodiments in which a metal plate 194 is affixed to or mortised in the bottom surface 184 of tailpiece 180, the metal plate 194 includes a second hole 218 substantially aligned with the second hole 212 in tailpiece 180, such that the second end 210 of the second screw 206 is configured to extend through the metal plate 194.

An alternative that may be used in place of or in addition to metal plate 194 is to incorporate bushings in the first and second holes, 176 and 212, respectively, of tailpiece 180.

As described above in connection with other presently preferred embodiments, each of the first end 172 of first screw 170 and the first end 208 of second screw 206 may include a slot 220 configured to receive an implement, as shown in FIG. 10, or a head with an optional milled edge (not shown).

To alter an acoustic property of a stringed instrument using the tailpiece adjustment mechanism 168 shown in FIG. 9, one or both of first screw 170 and second screw 206 is turned to either raise or lower at least a portion of either side of tailpiece 180, which in turn may alter the pressure on one or more of the bridge, soundpost, and bass bar, and/or change the effective length of one or more strings.

Figure 14:
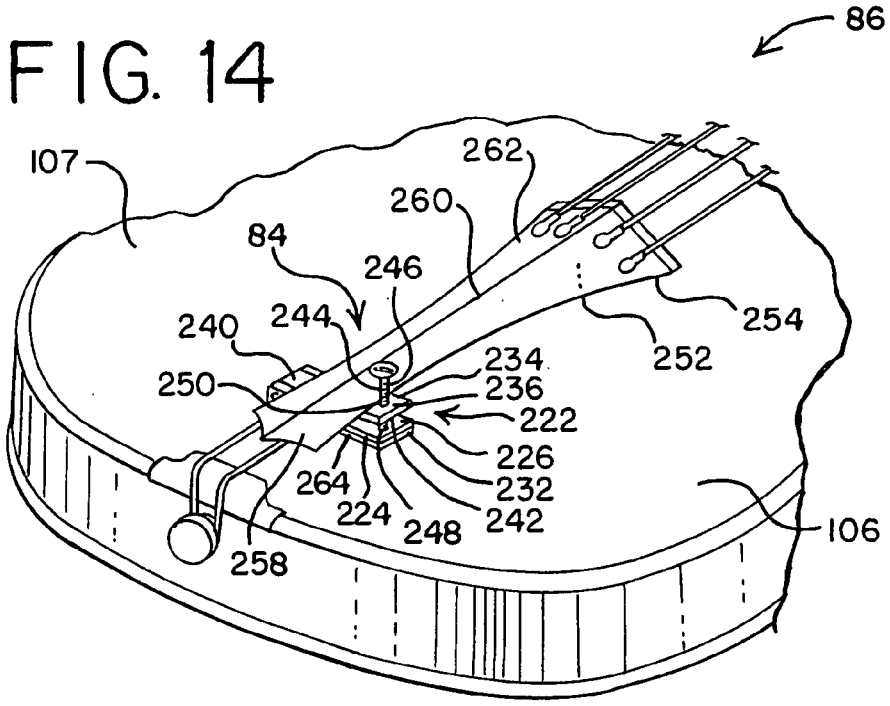
FIG. 14 shows a perspective view of a fourth device embodying features of the present invention shown in context with a portion of a representative stringed instrument.
Figure 15:
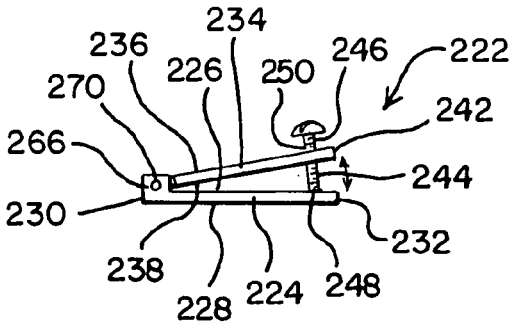
FIG. 15 shows a side view of the device shown in FIG. 14.
Figure 16:
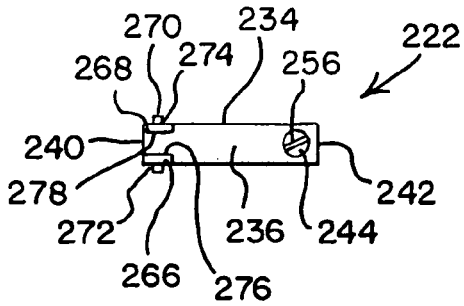
FIG. 16 shows a top view of the device shown in FIG. 14.

A fourth presently preferred embodiment in accordance with the present invention is shown in FIGS. 14-16. As shown in FIGS. 14 and 15, the tailpiece adjustment mechanism 222 includes (a) a base plate 224 having an upper surface 226 and a lower surface 228, and a first end 230 and a second end 232; (b) an adjusting plate 234 having an upper surface 236 and a lower surface 238, and a first end 240 and a second end 242; and (c) an adjusting screw 244 having a first end 246 and a second end 248.

Preferably, the first end 240 and the second end 242 of the adjusting plate 234 are substantially aligned, respectively, with the first end 230 and the second end 232 of the base plate 224. In addition, it is preferred that the adjusting plate 234 and the base plate 224 be hingedly connected at one of the ends thereof, such as at the first ends (230 and 240, respectively).

As shown in FIG. 14, the second end 242 of adjusting plate 234 includes a hole 250, and the upper surface 236 of adjusting plate 234 is configured to bear against a bottom surface 252 of the tailpiece 254. As shown in FIG. 15, the adjusting screw 244 is configured to be threaded through the hole 250 in adjusting plate 234, such that the first end 246 of adjusting screw 244 extends over the upper surface 236 of adjusting plate 234 adjacent to the tailpiece 254, and the second end 248 of adjusting screw 244 is configured to bear against the upper surface 226 of base plate 224. In this configuration, the adjusting plate 234 may be raised or lowered by turning the adjusting screw 244. As described above in connection with other presently preferred embodiments, the first end 246 of adjusting screw 244 may include a slot 256 configured to receive an implement, as shown in FIG. 16, or a head with an optional milled edge (not shown).

The tailpiece adjustment mechanism 222 shown in FIGS. 14-16 is configured for insertion beneath any portion of tailpiece 254. The tailpiece adjustment mechanism 222 may be inserted under a bottom portion 258 of tailpiece 254, as shown in FIG. 14, or under a middle portion 260 or a top portion 262 thereof as desired. Moreover, once fitted, the tailpiece adjustment mechanism 222 may be readily repositioned as desired by an operator. In addition, the tailpiece adjustment mechanism 222 may be inserted under tailpiece 254 such that the screw-containing end thereof faces either the treble side 106 or the bass side 107 of stringed instrument 86.

All manner of materials are contemplated for the construction of base plate 224 and adjusting plate 234, including but not limited to wood, metal, plastic, and the like, and combinations thereof. Preferably, at least the lower surface 228 of base plate 224 is contoured to the top surface 84 of stringed instrument 86. In addition, as shown in FIG. 14, it is presently preferred that a protecting member 264, such as a layer of cork, be interposed between the lower surface 228 of base plate 224 and the top surface 84 of stringed instrument 86. Preferably, the protecting member 264 is attached (e.g., with an adhesive) to the lower surface 228 of base plate 224.

As shown in FIGS. 15 and 16, the above-described hinged connection between base plate 224 and adjusting plate 234 may be achieved by providing a base plate 224 having a first raised end 266 and a second raised end 268, wherein the first and second raised ends, 266 and 268, respectively, extend vertically from and perpendicular to the upper surface 226 of base plate 224 at either the first end 230 or the second end 232 thereof. In such a configuration, as shown in FIGS. 15 and 16, the hinged connection may be provided by inserting a hinge pin 270 through each of a first hinge pin hole 272 in the first raised end 266 and a second hinge pin hole 274 in the second raised end 268. In accordance with this configuration, as shown in FIG. 16, the first end 240 of adjusting plate 234 is tapered to fit between an interior surface 276 of the first raised end 266 and an interior surface 278 of the second raised end 268. The tapered first end 240 of adjusting plate 234 includes a corresponding hole (not shown) to accommodate the hinge pin 270.

Alternatively, the above-described hinged connection may be achieved by fabricating a V-shaped member in which base plate 224 and adjusting plate 234 are joined at one end from a contiguous piece of material. The material (e.g., sheet metal, plastics, etc.) preferably exhibits an elastomeric or spring-like expansive force biased towards expanding the opening of the V.

To alter an acoustic property of a stringed instrument using the tailpiece adjustment mechanism 222 shown in FIG. 14, the adjusting screw 244 is turned to either raise or lower adjusting plate 234 and, in turn, at least a portion of either side of tailpiece 254, which in turn may alter the pressure on one or more of the bridge, soundpost, and bass bar, and/or change the effective length of one or more strings.

Figure 17:
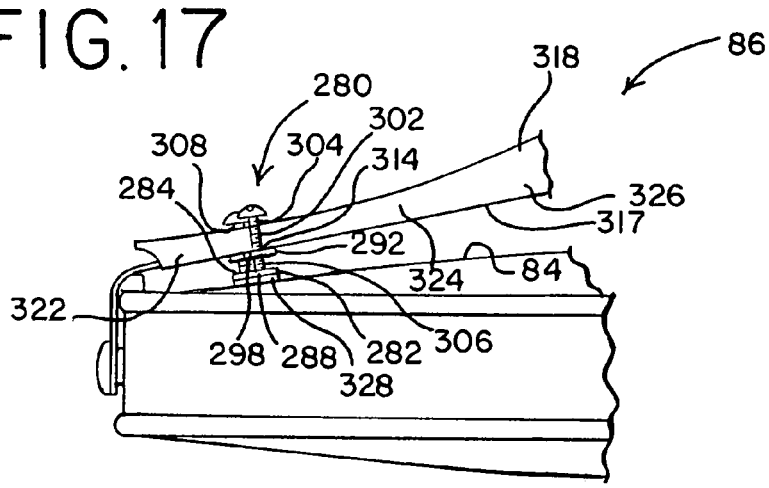
FIG. 17 shows a perspective view of a fifth device embodying features of the present invention shown in context with a portion of a representative stringed instrument.
Figure 18:
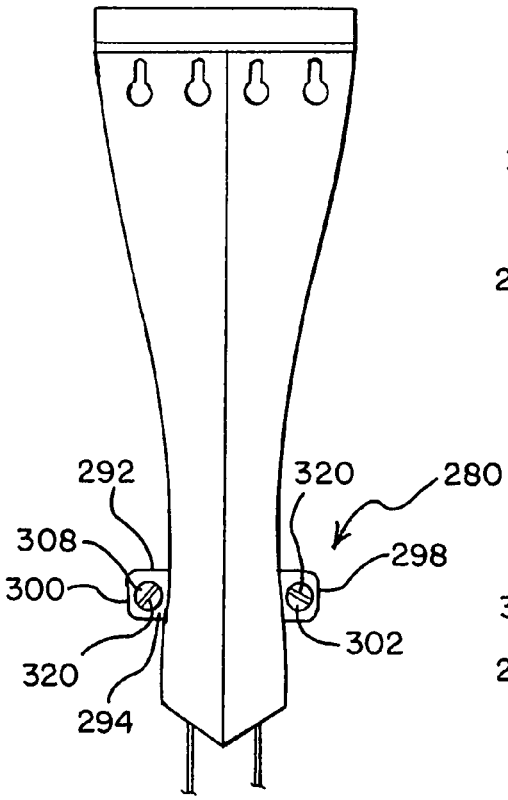
FIG. 18 shows a top view of the device shown in FIG. 17.
Figure 19:
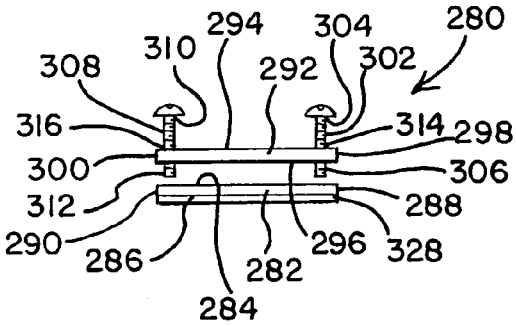
FIG. 19 shows a side view of the device shown in FIG. 17.
Figure 20:
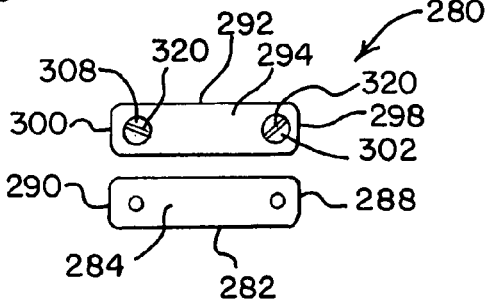
FIG. 20 shows an exploded top perspective view of the device shown in FIG. 17.

A fifth presently preferred embodiment in accordance with the present invention is shown in FIGS. 17-20. As shown in FIGS. 17, 19, and 20, the tailpiece adjustment mechanism 280 includes (a) a base plate 282 having an upper surface 284 and a lower surface 286, and a first end 288 and a second end 290; (b) an adjusting plate 292 configured to be superimposed over the base plate 282, wherein the adjusting plate 292 has an upper surface 294 and a lower surface 296, and a first end 298 and a second end 300; (c) a first adjusting screw 302 having a first end 304 and a second end 306; and, optionally, (d) a second adjusting screw 308 having a first end 310 and a second end 312.

Preferably, the first end 298 and the second end 300 of the adjusting plate 292 are configured to be substantially aligned, with the first end 288 and the second end 290 of the base plate 282, respectively. As shown in FIGS. 17 and 19, the first end 298 of adjusting plate 292 includes a hole 314 and the second end 300 of adjusting plate 292 includes a hole 316. The upper surface 294 of adjusting plate 292 is configured to bear against a bottom surface 317 of the tailpiece 318, as shown in FIG. 17.

For configurations of this fifth presently preferred embodiment that do not include the optional second adjusting screw 308, the second end 300 of adjusting plate 292 may be a continuous surface. However, to provide stability to the tailpiece adjustment mechanism 280 when it is positioned under a tailpiece 318 in such configurations, the second end 300 of adjusting plate 292 is preferably attached to the second end 290 of base plate 282, either hingedly as described above in connection with the fourth presently preferred embodiment or by another mechanism, including but not limited to the use of springs (e.g., spiral, volute, leaf, etc.). In such configurations, the first adjusting screw 302 may be positioned on either side of the plane of symmetry of the tailpiece. For stringed instruments in the violin family, the positioning of the first adjusting screw 302 is preferably determined according to which of the treble side and the bass side a player seeks to strengthen.

As shown in FIGS. 17 and 19, the first adjusting screw 302 is configured to be threaded through hole 314 in the first end 298 of adjusting plate 292. The first end 304 of first adjusting screw 302 is configured to extend over the upper surface 294 of adjusting plate 292 adjacent to the tailpiece 318, and the second end 306 of first adjusting screw 302 is configured to bear against the upper surface 284 of base plate 282. As further shown in FIGS. 17 and 19, the second adjusting screw 308 is configured to be threaded through hole 316 in the second end 300 of adjusting plate 292. The first end 310 of the second adjusting screw 308 is configured to extend over the upper surface 294 of adjusting plate 292 adjacent to the tailpiece 318 on a side opposite that of the first adjusting screw 302, and the second end 312 of second adjusting screw 308 is configured to bear against the upper surface 284 of base plate 282.

As shown in FIG. 17, the adjusting plate 292 may be raised or lowered on either side of tailpiece 318 by turning one or both of the first adjusting screw 302 and the second adjusting screw 308. As described above in connection with other presently preferred embodiments, the first end 304 of first adjusting screw 302 may include a slot 320 configured to receive an implement, as shown in FIGS. 18 and 20, or a head with an optional milled edge (not shown). Likewise, the first end 310 of second adjusting screw 308 may include a slot 320, as shown in FIGS. 18 and 20, or a head with an optional milled edge (not shown).

The tailpiece adjustment mechanism 280 shown in FIGS. 17-20 is configured for insertion beneath any portion of tailpiece 318. The tailpiece adjustment mechanism 280 may be inserted under a bottom portion 322 of tailpiece 318, as shown in FIG. 17, or under a middle portion 324 or a top portion 326 thereof as desired. Moreover, once fitted, the tailpiece adjustment mechanism 280 may be readily repositioned as desired by an operator.

All manner of materials are contemplated for the construction of base plate 282 and adjusting plate 292, including but not limited to wood, metal, plastic, and the like, and combinations thereof. Preferably, at least the lower surface 286 of base plate 282 is contoured to the top surface 84 of stringed instrument 86. In addition, as shown in FIGS. 17 and 19, it is presently preferred that a protecting member 328, such as a layer of cork, be interposed between the lower surface 286 of base plate 282 and the top surface 84 of stringed instrument 86. Preferably, the protecting member 328 is attached (e.g., with an adhesive) to the lower surface 286 of base plate 282.

To alter an acoustic property of a stringed instrument using the tailpiece adjustment mechanism 280 shown in FIG. 17, one or both of first adjusting screw 302 and second adjusting screw 308 is turned to either raise or lower adjusting plate 292 on at least a portion of either side of tailpiece 318, which in turn may alter the pressure on one or more of the bridge, soundpost, and bass bar, and/or change the effective length of one or more strings.

Figure 21:
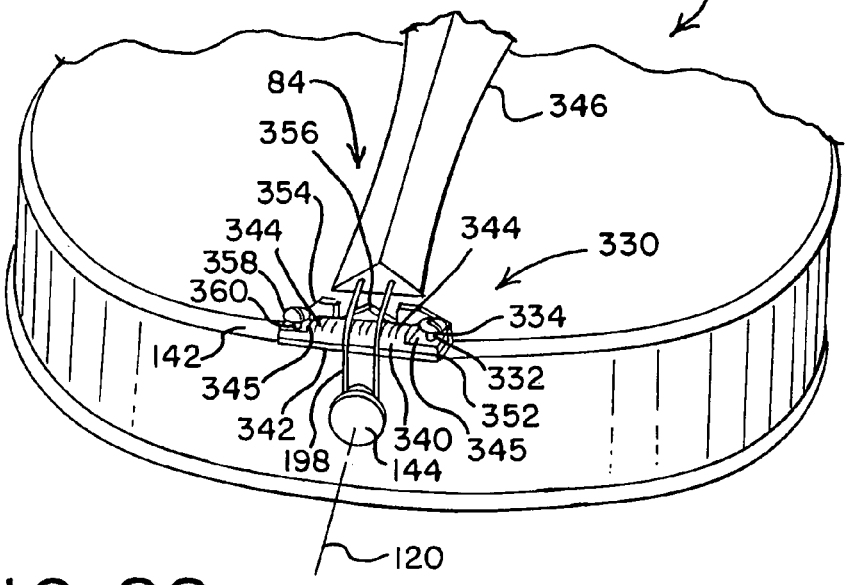
FIG. 21 shows a perspective view of a sixth device embodying features of the present invention shown in context with a portion of a representative stringed instrument.
Figure 22:
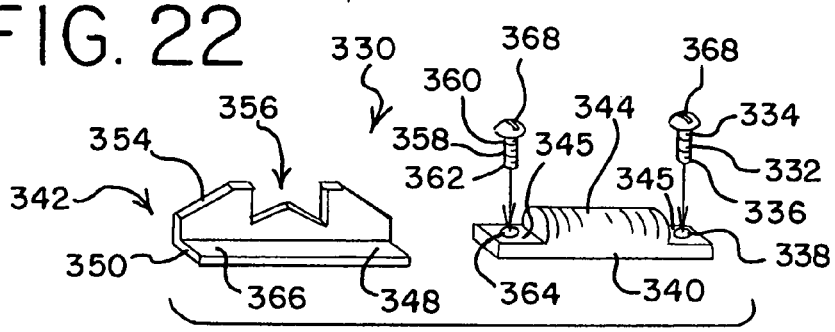
FIG. 22 shows an exploded perspective view of a second saddle embodying features of the present invention for use with the device shown in FIG. 21.

A sixth presently preferred embodiment in accordance with the present invention is shown in FIGS. 21-22. As shown in FIG. 21, the tailpiece adjustment mechanism 330 includes a first screw 332 having a first end 334 and a second end 336, which is configured for placement on either side of a plane of symmetry of the stringed instrument 86 (i.e., a plane that runs lengthwise through stringed instrument 86 and divides it into two substantially symmetrical halves; the plane of symmetry contains the central axis 120 described above).

As shown in FIGS. 21 and 22, the first screw 332 is configured to be threaded through a first hole 338 in an adjustable saddle member 340, and the adjustable saddle member 340 is configured to be superimposed on a stationary saddle member 342 connected to the stringed instrument 86 at a bottom edge 142 thereof. A top surface 344 of the adjustable saddle member 340 is configured to contact a tailgut 198 (e.g., a flexible material such as gut, metal, nylon or the like), which connects the tailpiece 346 to an end button 144 of stringed instrument 86, as shown in FIG. 21. As further shown in FIG. 21, the first end 334 of first screw 332 is configured to extend over an upper surface 345 of adjustable saddle member 340, which upper surface 345 may or may not be coplanar with top surface 344 depending on the design of adjustable saddle member 340 (e.g., whether the portion of adjustable saddle member 340 containing first hole 338 slopes away from top surface 344, as shown in FIGS. 21 and 22, or whether the portion containing first hole 338 is substantially coplanar with the top surface 344). The second end 336 of first screw 332 is configured to extend through a bottom surface (not shown) of adjustable saddle member 340, and is configured to contact a first bearing surface 348 provided by the stationary saddle member 342.

Although the adjustable saddle member 340 may be used in combination with a conventional saddle, such as saddle 54 shown in FIG. 1, the bearing forces exerted by the second end 336 of first screw 332 are likely to cause damage to the saddle, which typically is crafted from a wood such as ebony or from ivory. Moreover, the exposed surface of a conventional saddle is typically rounded, whereas a substantially flattened surface is presently preferred for stationary saddle member 342 in order to better accommodate the adjustable saddle member 340 and to increase the surface contact therewith. In addition, although the exposed surface of a conventional saddle is typically slightly raised relative to the table of the instrument, the elevation and design are generally not optimum for contacting the tailgut 198 in accordance with this presently preferred embodiment. For these reasons, it is presently preferred that the stationary saddle member 342 have a modified configuration, such as that shown in FIG. 22.

As shown in FIG. 22, the stationary saddle member 342 includes a horizontal element 350, preferably made of wood (e.g., ebony, boxwood, rosewood, etc.) or ivory, which is suitable for installation in the bottom edge 142 of stringed instrument 86. In one embodiment of the stationary saddle member 342, the horizontal element 350 may itself provide the first bearing surface 348. However, since horizontal element 350 is preferably made of wood or ivory, which potentially could be damaged by contact from the second end 336 of first screw 332, it is presently preferred that a separate bearing layer 352, preferably made of metal (e.g., brass) or plastic, be superimposed on the horizontal element 350 in order to provide the first bearing surface 348. Preferably, the bearing layer 352 is affixed to the horizontal element 350 (e.g., with an adhesive).

As shown in FIG. 22, the stationary saddle member 342 further includes an elevating surface 354, which is substantially perpendicular to the horizontal element 350 and, therefore, to the first bearing surface 348. The elevating surface 354 extends above the top surface 84 of stringed instrument 86 and is configured to contact the tailgut 198. As shown in FIG. 22, the elevating surface 354 preferably includes a W-shaped notch 356.

In certain configurations of the sixth presently preferred embodiment depicted in FIGS. 21 and 22, only one adjustable screw is included in the tailpiece adjustment mechanism 330. In such configurations, the first screw 332 may be positioned on either side of the plane of symmetry of the stringed instrument 86. For stringed instruments in the violin family, the positioning of first screw 332 is preferably determined according to which of the treble side and the bass side a player seeks to strengthen.

In alternative configurations of the sixth presently preferred embodiment depicted in FIGS. 21 and 22, the tailpiece adjustment mechanism 330 further includes a second screw 358 that is positioned on a side of the plane of symmetry opposite to the side containing the first screw 332.

As shown in FIG. 22, the second screw 358 is substantially identical to the first screw 332 and includes a first end 360 and a second end 362. The second screw 358 is threaded through a second hole 364 in the adjustable saddle member 340, such that the first end 360 of second screw 358 extends over the upper surface 345 of adjustable saddle member 340, and the second end 362 of second screw 358 extends through the bottom surface (not shown) of adjustable saddle member 340. As described above, the upper surface 345 may or may not be coplanar with the top surface 344 depending on the design of adjustable saddle member 340 (e.g., whether the portion of adjustable saddle member 340 containing second hole 364 slopes away from top surface 344, as shown in FIGS. 21 and 22, or whether the portion containing first hole 364 is substantially coplanar with the top surface 344). The second end 362 of second screw 358 is configured to contact a second bearing surface 366 provided by the stationary saddle member 342.

For configurations of the sixth presently preferred embodiment depicted in FIGS. 21 and 22 in which the tailpiece adjustment mechanism 330 includes first and second screws 332 and 358, respectively, both the first bearing surface 348 and the second bearing surface 366 may be provided by the horizontal element 350. Alternatively, in embodiments in which the horizontal element 350 includes a bearing layer 352 superimposed thereon, the first bearing surface 348 and the second bearing surface 366 may be provided by bearing layer 352.

As described above in connection with other presently preferred embodiments, each of the first end 334 of first screw 332 and the first end 360 of second screw 358 may include a slot 368 configured to receive an implement, as shown in FIG. 22, or a head with an optional milled edge (not shown).

To alter an acoustic property of a stringed instrument using the tailpiece adjustment mechanism 330 shown in FIG. 21, one or both of first screw 332 and second screw 358 is turned to either raise or lower at least a portion of the adjustable saddle member 340 on either side of tailpiece 346, which in turn may alter the pressure on one or more of the bridge, soundpost, and bass bar, and/or change the effective length of one or more strings.

In the presently preferred embodiments described above, the tailpiece adjustment mechanisms include one or a plurality of screws as adjustable members. Although screws are presently preferred adjustable members for use in accordance with the present invention, the present invention is not limited thereto. All manner of alternative means for adjusting, and all equivalents thereto, can also be employed to adjust the distance between a top surface of a stringed instrument and at least a portion of its tailpiece and/or a position of at least a portion of the tailpiece with respect to the central axis of the instrument. Representative alternative means for adjusting include but are not limited to mechanical adjustment means, electrical adjustment means, pneumatic adjustment means, hydraulic adjustment means, and the like, and combinations thereof. By way of illustration, a description of representative alternative means for adjusting that may be used in accordance with the present invention is provided below. It is to be understood that this description is not comprehensive but rather is merely illustrative.

A first alternative means for adjusting includes a snug-fitting tongue-and-groove assembly. The tongue portion of the assembly may include a handle by which an operator may slide the top edge of the tongue to extend over a top edge of the groove, thereby raising a surface in contact with the top edge of the tongue (e.g., the undersurface of a tailpiece). Conversely, the operator may lower the top edge of the tongue until it becomes substantially flush with the top edge of the groove, thereby lowering the surface that had previously been raised. The snug fit of the tongue within the groove substantially prevents the tongue once raised from returning to a lowered position.

A second alternative means for adjusting includes a snug-fitting telescoping tube assembly. The inner tube of the assembly may include a handle by which an operator may raise the top edge of the inner tube to extend over a top edge of the outer tube, thereby raising a surface in contact with the top edge of the inner tube (e.g., the undersurface of a tailpiece). Conversely, the operator may lower the top edge of the inner tube until it becomes substantially flush with the top edge of the outer tube, thereby lowering the surface that had previously been raised. The snug fit of the inner tube within the outer tube substantially prevents the inner tube once raised from returning to a lowered position.

A third alternative means for adjusting includes a telescoping tube assembly in which an extended height of the inner tube (e.g., the height at which a surface in contact with the top edge of the inner tube has reached a target elevation) may be held in place by tightening a collar positioned over the top edge of the outer tube. This type of assembly is analogous to the mechanism commonly used in height adjustable music stands.

A fourth alternative means for adjusting includes a telescoping tube assembly in which a desired extended height of the inner tube may be held in place by tightening a screw through a hole in the outer tube until it bears against a surface on the inner tube, thereby substantially preventing slipping.

A fifth alternative means for adjusting includes the combination of cylindrical element comprising a column of ratchet-like teeth positioned at regular intervals along the height and a height adjustable collar element containing an elevating surface and a pawl. The height adjustable collar element is configured to slide along the outer surface of the cylindrical element when the pawl is in a raised position and to remain substantially fixed when the pawl engages one of the ratchet-like teeth. The cylindrical element may be positioned adjacent to a surface to be raised or lowered (e.g., a tailpiece), such that the elevating surface of the height adjustable collar element may be positioned under the surface to be raised or lowered. Thus, the desired height of the elevating surface (e.g., the height at which a surface in contact with the elevating surface has reached a target elevation) may be maintained by engaging the pawl with the nearest ratchet-like tooth.

A sixth alternative means for adjusting includes an appropriately sized jack (e.g., mechanical, pneumatic or hydraulic), which can be configured for use on a stringed instrument in accordance with design principles known to those of ordinary skill in the art.

In the presently preferred embodiments described above, the tailpiece adjustment mechanisms embodying features of the present invention include at least one adjustable member. However, the present invention is not limited thereto. Alternative tailpiece adjustment mechanisms in accordance with the present invention, such as the representative embodiments described below, are themselves adjustable and do not include further adjustable members.

Figure 23:
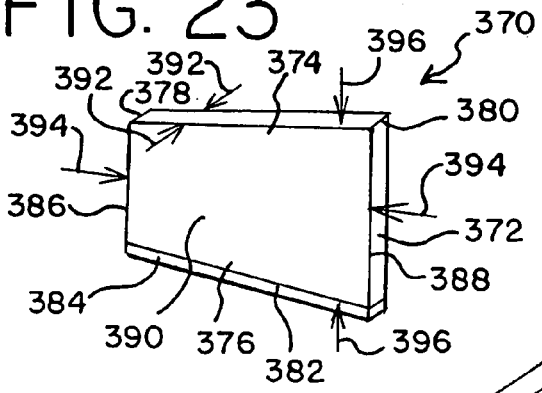
FIG. 23 shows a perspective view of a seventh device embodying features of the present invention.

A seventh presently preferred embodiment in accordance with the present invention is shown in FIG. 23. As shown in FIG. 23, the tailpiece adjustment mechanism 370 includes a bridging element 372, at least a portion of which is configured for placement underneath a tailpiece (e.g., a conventional tailpiece such as tailpiece 30 shown in FIG. 1). The bridging element 372 includes a tailpiece adjusting side 374, at least a portion of which is configured to contact a bottom surface of a tailpiece, and a supporting side 376, at least a portion of which is configured to contact a top surface of a stringed instrument.

As shown in FIG. 23, the tailpiece adjusting side 374 of bridging element 372 includes a first end 378 and a second end 380. The distance between supporting side 376 and second end 380 is preferably greater than the distance between supporting side 376 and first end 378, such that when tailpiece adjustment mechanism 370 is interposed in an upright position between the top surface of a stringed instrument and the bottom surface of a tailpiece, second end 380 will be higher than first end 378. In such a configuration, second end 380 is configured to bear against a bottom surface of the tailpiece on the side of the tailpiece closest thereto, thereby elevating at least a portion of one of the symmetrical halves of the tailpiece (i.e., the half nearest second end 380). Depending on the magnitude of the distance between supporting side 376 and first end 378 and on the flexibility of the material used to construct the tailpiece, first end 378 may or may not bear against a bottom surface of the tailpiece when second end 380 bears against a bottom surface on a side of the tailpiece opposite thereto. It is presently preferred that the tailpiece adjusting side 374 of bridging element 372 be configured to contact the bottom surface of a tailpiece along substantially the entire length thereof, such that first end 378 contacts a bottom surface in one of the symmetrical halves of the tailpiece and second end 380 contacts a bottom surface in the other symmetrical half of the tailpiece.

All manner of materials are contemplated for the construction of bridging element 372, including but not limited to wood, metal (e.g., gold, silver, copper, etc.), metal alloys (e.g., brass, bronze, etc.), plastic, and the like, and combinations thereof. Preferably, at least a lower surface 382 of supporting side 376 is contoured so as to substantially match the contour of the top surface of a stringed instrument where it is to be placed and/or is sufficiently flexible (e.g., by manufacturing the bridging element 372 from a sufficiently flexible plastic) so as to bend to match this contour. For certain stringed instruments, such as a violin, the top surface of the instrument underneath the tailpiece is relatively flat and contains little if any curvature. In such instances, the lower surface 382 of supporting side 376 may likewise include little or no curvature.

As shown in FIG. 23, it is presently preferred that a protecting member 384, such as a layer of cork, be interposed between the lower surface 382 of supporting side 376 and the top surface of the stringed instrument on which it is to be placed. Preferably, the protecting member 384 is attached (e.g., with an adhesive) to the lower surface 382 of supporting side 376.

The tailpiece adjustment mechanism 370 shown in FIG. 23 is configured for insertion beneath any portion of a tailpiece between the broad top edge thereof (e.g., broad top edge 46 shown in FIG. 1) and the narrow bottom edge thereof (e.g., narrow bottom edge 48 shown in FIG. 1). Since the separation between the top surface of a stringed instrument and the bottom surface of a tailpiece typically decreases moving from the broad top edge towards the narrow bottom edge, the tailpiece adjustment mechanism 370 shown in FIG. 23 is preferably introduced in a substantially upright position near the broad top edge of the tailpiece where the separation is typically greatest and insertion may be easiest. Alternatively, the tailpiece adjustment mechanism 370 may be introduced prior to installation and fitting of the tailpiece and strings onto the stringed instrument.

As the separation between the top surface of a stringed instrument and the bottom surface of a tailpiece becomes progressively smaller, the bearing force exerted by second end 380 on the bottom surface of the tailpiece becomes progressively larger. Thus, as tailpiece adjustment mechanism 370 is moved from the broad top edge towards the narrow bottom edge of the tailpiece, resistance may develop. Depending on the specific dimensions and configuration of an instrument and its set up, which typically vary between different members in a family of instruments (e.g., a violin and a viola) as well as between individual examples of the same instrument (e.g., two violins), a point may be reached at which additional movement of tailpiece adjustment mechanism 370 in a particular direction would require the application of undue force by a user. If this point is reached, the tailpiece adjustment mechanism 370 should preferably not be forced if such forcing would potentially cause damage to the instrument.

The degree to which a portion of a tailpiece is elevated using tailpiece adjustment mechanism 370 may be increased by moving the tailpiece adjustment mechanism 370 away from the bridge (e.g., bridge 36 shown in FIG. 1) and towards the narrow bottom edge of the tailpiece (e.g., narrow bottom edge 48 shown in FIG. 1) while maintaining bridging element 372 in a substantially upright position. Conversely, the degree to which a portion of a tailpiece has been elevated using tailpiece adjustment mechanism 370 may be decreased by moving the tailpiece adjustment mechanism 370 closer to the bridge and away from the narrow bottom edge of the tailpiece.

Once fitted between the top surface of a stringed instrument and the bottom surface of a tailpiece, the tailpiece adjustment mechanism 370 may be readily repositioned as desired by a user. Preferably, the repositioning is achieved by applying pressure substantially simultaneously to both a first edge 386 and a second edge 388 of bridging element 372. Preferably, the bridging element 372 is held near first edge 386 with the fingers of one hand and near second edge 388 with the fingers of the other hand so as to more equally distribute the force applied to bridging element 372.

It is presently preferred that tailpiece adjustment mechanism 370 be positioned under a tailpiece in an upright position such that a face 390 of bridging element 372 is approximately perpendicular to a central axis of the stringed instrument. In such a configuration, the face 390 of bridging element 372 shown in FIG. 23 will be approximately parallel to the bridge of instruments in the violin family (e.g., bridge 36 of violin 2 shown in FIG. 1). Although such an arrangement is preferable in order to increase the stability of bridging element 372 under the tailpiece and to minimize and/or prevent slippage or accidental displacement from occurring, the bridging element 372 may also be positioned so that face 390 forms an angle that is less than or greater than 90 degrees with respect to the central axis of the instrument. This configuration of the tailpiece adjustment mechanism 370 will also generally suffice to alter an acoustic property of the stringed instrument.

Dimensions of tailpiece adjustment mechanism 370 shown in FIG. 23—such as thickness 392, width 394, and height 396—are not limited and may be readily determined by one of ordinary skill in the art based on the type and dimensions of a particular stringed instrument. For example, with instruments in the violin family, the thickness 392 of bridging element 372 may approximate the thickest portion of the bridge (e.g., bridge 36 of violin 2 shown in FIG. 1), although other thicknesses may likewise be used. Increasing the thickness 392 of bridging element 372 shown in FIG. 23 beyond the thickness of a conventional bridge may increase the stability of the tailpiece adjustment mechanism 370 when it is positioned under a tailpiece in an upright position. In addition, for instruments in the violin family, the width 394 of bridging element 372 may approximate the widest portion of the bridge although other widths may likewise be used. It is presently preferable that the width 394 of bridging element 372 be at least as wide as the width of the broad top edge of the tailpiece (e.g., broad top edge 46 shown in FIG. 1), such that the bridging element 372 will be able to contact both sides of the tailpiece regardless of whether it is positioned in a bottom, middle or top portion thereof.

The shape of bridging element 372 is not limited and may include all manner of regular or irregular geometric shapes that may be used to rotate at least a portion of a tailpiece in accordance with the present invention. In addition, it is to be understood that the bridging element 372 may be a solid body such as shown in FIG. 23 or perforated. For example, alternative bridging elements embodying features of the present invention may be designed to resemble the general shape and ornamental design of conventional bridges and may, for example, be provided with feet at supporting side 376.

Presently preferred shapes for bridging element 372 include but are not limited to prisms, such as quadrilateral prisms and trilateral prisms. A quadrilateral prism, such as that shown in FIG. 23, is a presently preferred shape for bridging element 372. In alternative configurations, such as in tailpiece adjustment mechanism 398 shown in FIG. 24, the bridging element 400 may be triangular prismatic in shape. In such alternative configurations, it is presently preferred that the congruent parallel faces of the triangular prism correspond to scalene triangles.

Figure 25:
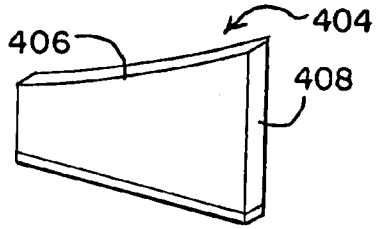
FIG. 25 shows a perspective view of a second modification to the device shown in FIG. 23.

As shown in FIG. 23, the tailpiece adjusting side 374 of prismatic bridging element 372 is provided by a straight uncurved segment. In alternative configurations, such as in tailpiece adjustment mechanism 404 shown in FIG. 25, the tailpiece adjusting side 406 of bridging element 408 may be curved-either concavely as shown in FIG. 25 or convexly (not shown). It is presently preferred that the tailpiece adjusting side of bridging elements in accordance with the present invention be substantially uncurved so as to substantially match the typically uncurved bottom surface of conventional tailpieces.

To alter an acoustic property of a stringed instrument using the tailpiece adjustment mechanism 370 shown in FIG. 23, the bridging element 372 is positioned in an upright position underneath a tailpiece such that the second end 380 (i.e., the higher side) is configured to bear against a bottom surface of the tailpiece in one of the symmetrical halves at which elevation is desired. It should be noted that the same tailpiece adjustment mechanism may also be used to elevate the opposite symmetrical half of the tailpiece. For example, if a user determines that a desired acoustic property may be better achieved by elevating at least a portion of the tailpiece on a side opposite that currently being elevated (i.e., the side nearest second end 380), the tailpiece adjustment mechanism 370 may be removed from under the tailpiece, turned 180 degrees relative to its original configuration, and repositioned such that second end 380 will be closest to the other side of the tailpiece. All of the preceding description relating to the tailpiece adjustment mechanism 370 shown in FIG. 23 applies equally to alternative tailpiece adjustment mechanisms, such as 398 and 404 shown in FIGS. 24 and 25, respectively.

Figure 24:
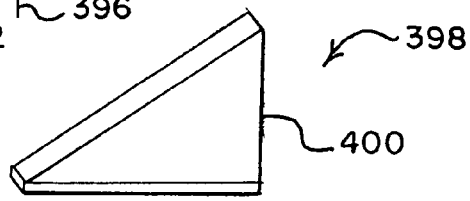
FIG. 24 shows a perspective view of a first modification to the device shown in FIG. 23.

It is presently preferred, particularly for stringed instruments in the violin family, that the tailpiece adjustment mechanisms shown in FIGS. 23-25 be placed so that the weaker side of an instrument may be strengthened thereby. As noted above, an acoustic property of a stringed instrument in the violin family may be altered in accordance with the present invention by transferring pressure on the bridge from either the soundpost to the bass bar or vice versa. By way of illustration, if the weaker side of a particular violin corresponds to its G-string side or bass side, the tailpiece adjustment mechanism 370 shown in FIG. 23 may be preferably positioned under a tailpiece such that the higher second end 380 is located on the E-string side or treble side of the instrument. In such a configuration, the pressure on the treble side of the instrument is reduced and the pressure on the bass side is increased. Conversely, if the weaker side of a particular violin corresponds to its E-string side or treble side, the tailpiece adjustment mechanism 370 shown in FIG. 23 may be preferably positioned under a tailpiece such that the higher second end 380 is located on the G-string side or bass side. In such a configuration, the pressure on the bass side of the instrument is reduced and the pressure on the treble side is increased.

Figure 26:
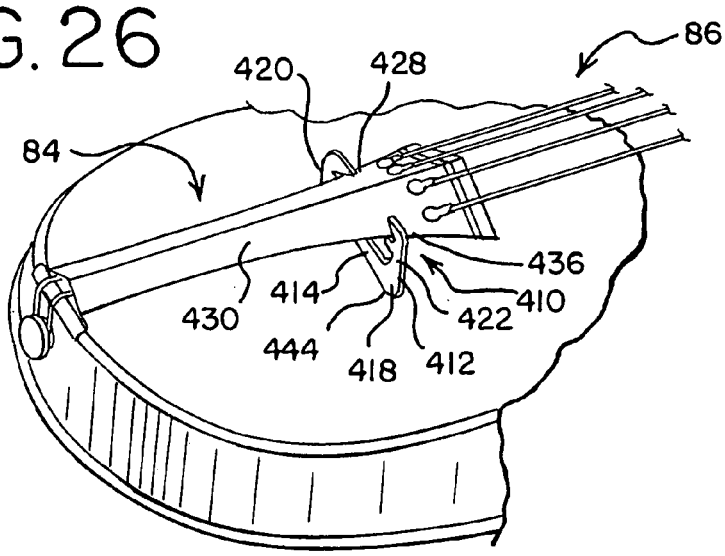
FIG. 26 shows a perspective view of an eighth device embodying features of the present invention shown in context with a portion of a representative stringed instrument.
Figure 27:
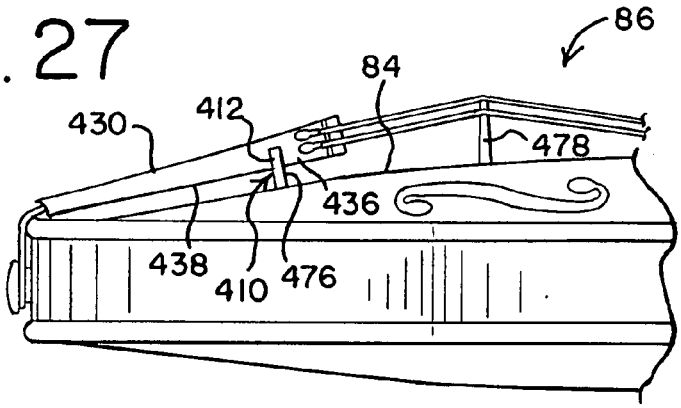
FIG. 27 shows a side view of the device shown in FIG. 26 in context with a portion of a representative stringed instrument.
Figure 28:
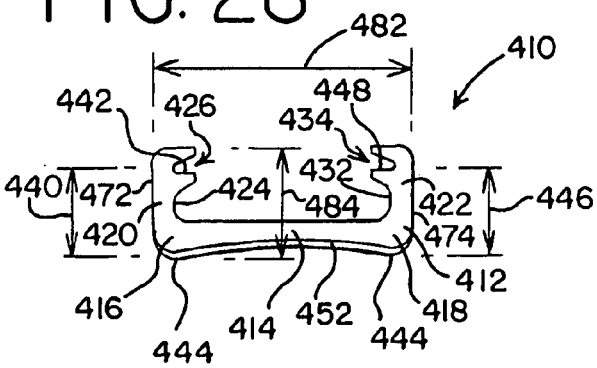
FIG. 28 shows a side view of the device shown in FIG. 26.

An eighth presently preferred embodiment in accordance with the present invention is shown in FIGS. 26-29. As shown in FIGS. 26 and 28, the tailpiece adjustment mechanism 410 includes a bridging element 412, at least a portion of which is configured for placement underneath a tailpiece (e.g., a conventional tailpiece such as tailpiece 30 shown in FIG. 1). The bridging element 412 includes a supporting base 414 having a first end 416 and a second end 418, a first stanchion 420 connected to the first end 416 of supporting base 414, and a second stanchion 422 connected to the second end 418 of supporting base 414. As shown in FIG. 28, an interior surface 424 of first stanchion 420 includes at least one notch 426 configured for contacting a first side 428 of a tailpiece 430. In addition, an interior surface 432 of second stanchion 422 includes at least one notch 434 configured for contacting a second side 436 of tailpiece 430. It is presently preferred that the shapes of notches 426 and 434 be configured to be substantially complementary to the contour of the sides of tailpiece 430 (i.e., first side 428 and second side 436).

As shown in FIGS. 26 and 27, the tailpiece adjustment mechanism 410 is interposed in an upright position between the top surface 84 of a stringed instrument 86 and the bottom surface 438 of tailpiece 430. In this configuration, the first side 428 of tailpiece 430 is configured to contact the notch 426 in the interior surface 424 of first stanchion 420, and the second side 436 of tailpiece 430 is configured to contact the notch 434 in the interior surface 432 of second stanchion 422.

In the tailpiece adjustment mechanism 410 shown in FIG. 28, each of first stanchion 420 and second stanchion 422 contains one notch (426 and 434, respectively), which are arranged such that the notch 426 in interior surface 424 is substantially in alignment with the notch 434 in opposing interior surface 432. In this configuration, a distance 440 between a tailpiece supporting surface 442 of notch 426 and a lower surface 444 of supporting base 414 (i.e., the surface configured to contact the top surface 84 of stringed instrument 86) will be substantially equal to a distance 446 between a tailpiece supporting surface 448 of notch 434 and the lower surface 444 of supporting base 414. In alternative configurations described below, distances 440 and 446 are not the same.

Depending on the magnitude of distances 440 and 446 shown in FIG. 28 and on whether distances 440 and 446 are the same or different, the tailpiece adjustment mechanism 410 may be used to (a) rotate (e.g., elevate or lower) first side 428 and/or second side 436 of tailpiece 430, and/or to (b) immobilize at least a portion of tailpiece 430 with or without substantially rotating (e.g., elevating or lowering) any portion thereof.

In a first presently preferred configuration, the distances 440 and 446 may be the same or different and are both larger than an "ambient distance" between the top surface 84 of stringed instrument 86 and a bottom surface 438 of tailpiece 430. In this context, the phrase "ambient distance" refers to a distance prior to rotation of the tailpiece, which is determined at or near that portion of the tailpiece under which the tailpiece adjustment mechanism 410 is to be inserted. In this first presently preferred configuration, each of first side 428 and second side 436 of tailpiece 430 will be elevated to the same or a different degree when tailpiece 430 is positioned in notches 426 and 434.

In a second presently preferred configuration, the distances 440 and 446 may be the same or different and are both smaller than an "ambient distance" between the top surface 84 of stringed instrument 86 and a bottom surface 438 of tailpiece 430. In this second presently preferred configuration, each of first side 428 and second side 436 of tailpiece 430 will be lowered to the same or a different degree when tailpiece 430 is positioned in notches 426 and 434.

In a third presently preferred configuration, the distances 440 and 446 are substantially equal in magnitude and are substantially equal to an "ambient distance" between the top surface 84 of stringed instrument 86 and a bottom surface 438 of tailpiece 430. In this third presently preferred configuration, neither first side 428 nor second side 436 of tailpiece 430 will be substantially elevated or lowered but tailpiece 430 will be immobilized and will exhibit reduced vibrations when stringed instrument 86 is played.

In a fourth presently preferred configuration, the distance 440 is larger than the distance 446 and larger than an "ambient distance" between the top surface 84 of stringed instrument 86 and a bottom surface 438 of tailpiece 430. In this fourth presently preferred configuration, either first side 428 or second side 436 of tailpiece 430 may be elevated by positioning the side to be elevated in notch 426. To elevate the opposite side of tailpiece 430 in accordance with this fourth presently preferred configuration, the tailpiece adjustment mechanism 410 may be removed from under tailpiece 430, turned 180 degrees relative to its original configuration, and repositioned such that the opposite side of tailpiece 430 is positioned in notch 426.

All manner of materials are contemplated for the construction of bridging element 412, including but not limited to wood, metal (e.g., gold, silver, copper, etc.), metal alloys (e.g., brass, bronze, etc.), plastic, and the like, and combinations thereof. Preferably, at least a portion of the lower surface 444 of supporting base 414 is contoured so as to substantially match the contour of the top surface 84 of stringed instrument 86 where it is to be placed and/or is sufficiently flexible (e.g., by manufacturing the bridging element 412 from a sufficiently flexible plastic) so as to bend to match this contour. For certain stringed instruments, such as a violin, the top surface of the instrument underneath the tailpiece is relatively flat and contains little if any curvature. In such instances, lower surface 444 of supporting base 414 may likewise include little or no curvature.

Figure 29:
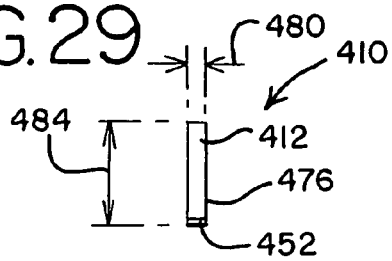
FIG. 29 shows an end view of the device shown in FIG. 26.

As shown in FIGS. 28 and 29, it is presently preferred that a protecting member 452, such as a layer of cork, be interposed between the lower surface 444 of supporting base 414 and the top surface 84 of stringed instrument 86 on which it is to be placed. Preferably, the protecting member 452 is attached (e.g., with an adhesive) to the lower surface 444 of supporting base 414.

Figure 30:
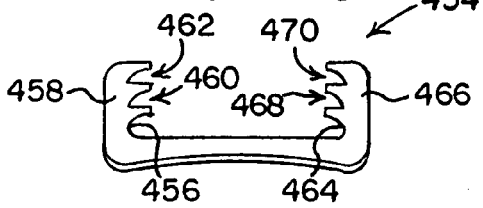
FIG. 30 shows a side view of a first modification to the device shown in FIG. 26.

In the tailpiece adjustment mechanism 410 shown in FIGS. 26 and 28, the interior surface 424 of first stanchion 420 and the interior surface 432 of second stanchion 422 each contains one notch (426 and 434, respectively). However, in alternative configurations, such as in tailpiece adjustment mechanism 454 shown in FIG. 30, a plurality of notches are included in each of the interior surfaces of the first and second stanchions. For example, as shown in FIG. 30, an interior surface 456 of a first stanchion 458 includes first and second notches, 460 and 462, respectively, each of which is configured for contacting a side of tailpiece 430. Similarly, an interior surface 464 of second stanchion 466 includes first and second notches, 468 and 470, respectively, each of which is configured for contacting the opposite side of tailpiece 430. As shown in FIG. 30, first notch 460 in interior surface 456 is substantially in alignment with first notch 468 in opposing interior surface 464, and second notch 462 in interior surface 456 is substantially in alignment with second notch 470 in opposing interior surface 464. However, alignment of opposing notches is not a requirement and a staggered arrangement of opposing notches may also be employed in accordance with the present invention. In addition, it is to be understood that additional notches in interior surfaces 456 and 464 may also be employed, and that the number of notches in opposing interior surfaces 456 and 464 may be the same or different. All of the preceding and following description relating to the tailpiece adjustment mechanism 410 shown in FIGS. 26-29 applies equally to the tailpiece adjustment mechanism 454 shown in FIG. 30.

The tailpiece adjustment mechanism 410 shown in FIGS. 26-29 is configured for insertion beneath any portion of a tailpiece between the broad top edge thereof (e.g., broad top edge 46 shown in FIG. 1) and the narrow bottom edge thereof (e.g., narrow bottom edge 48 shown in FIG. 1). Since the separation between the top surface of a stringed instrument and the bottom surface of a tailpiece typically decreases moving from the broad top edge towards the narrow bottom edge, the tailpiece adjustment mechanism 410 is preferably introduced in a substantially upright position near the broad top edge of a tailpiece where the separation is typically greatest and insertion may be easiest. Alternatively, the tailpiece adjustment mechanism 410 may be introduced prior to installation and fitting of the tailpiece and strings onto the stringed instrument.

As the separation between the top surface 84 of stringed instrument 86 and the bottom surface 438 of tailpiece 430 becomes progressively smaller, the bearing force exerted by bottom surface 438 on the tailpiece supporting surfaces 442 and 448 becomes progressively larger. Thus, as tailpiece adjustment mechanism 410 is moved from the broad top edge towards the narrow bottom edge of the tailpiece, resistance may develop. Depending on the specific dimensions and configuration of an instrument and its set up, which typically vary between different members in a family of instruments (e.g., a violin and a viola) as well as between individual examples of the same instrument (e.g., two violins), a point may be reached at which additional movement of tailpiece adjustment mechanism 410 in a particular direction would require the application of undue force by a user. If this point is reached, the tailpiece adjustment mechanism 410 should preferably not be forced if such forcing would potentially cause damage to the instrument.

The degree to which a portion of a tailpiece is elevated using tailpiece adjustment mechanism 410 may be increased by (a) moving the tailpiece adjustment mechanism 410 away from the bridge towards the narrow bottom edge of the tailpiece while maintaining bridging element 412 in a substantially upright position, and/or by (b) employing a configuration of tailpiece adjustment mechanism 410 in which distances 440 and 446 are different (e.g., a tailpiece adjustment mechanism 410 in which distance 440 is larger than distance 446 and the side of tailpiece 430 to be elevated is positioned in notch 426). Conversely, the degree to which a portion of a tailpiece has been elevated using tailpiece adjustment mechanism 410 may be decreased by (a) moving the tailpiece adjustment mechanism 410 closer to the bridge and away from the narrow bottom edge of the tailpiece, and/or by (b) employing a configuration of tailpiece adjustment mechanism 410 in which distances 440 and 446 are different (e.g., a tailpiece adjustment mechanism 410 in which distance 440 is smaller than distance 446 and the side of tailpiece 430 to be lowered is positioned in notch 426). In alternative configurations of tailpiece adjustment mechanisms embodying features of the present invention, such as in tailpiece adjustment mechanism 454 shown in FIG. 30, additional controls over the elevation or lowering of the sides of tailpiece 430 are provided by the plurality of notches 460, 462, 468, and 470 included in the interior surfaces 456 and 464 of first and second stanchions, 458 and 466. By way of example, tailpiece adjustment mechanism 454 may be used to elevate the first side 428 of tailpiece 430 relative to the second side 436 by positioning the first side 428 in second notch 462 and by positioning the second side 436 in first notch 468.

Once fitted between the top surface 84 of stringed instrument 86 and the bottom surface 438 of tailpiece 430, as shown in FIGS. 26 and 27, the tailpiece adjustment mechanism 410 may be readily repositioned as desired by a user. Preferably, the repositioning is achieved by applying pressure substantially simultaneously to both a first edge 472 and a second edge 474 of bridging element 412. Preferably, the bridging element 412 is held near first edge 472 with the fingers of one hand and near second edge 474 with the fingers of the other hand so as to more equally distribute the force applied to bridging element 412.

It is presently preferred that tailpiece adjustment mechanism 410 be positioned under a tailpiece in an upright position such that a face 476 of bridging element 412 is approximately perpendicular to a central axis of the stringed instrument. In such a configuration, as shown in FIG. 27, the face 476 of bridging element 412 will be approximately parallel to bridge 478 of stringed instruments 86. Although such an arrangement is preferable in order to increase the stability of bridging element 412 under the tailpiece and to minimize and/or prevent slippage or accidental displacement from occurring, the bridging element 412 may also be positioned so that face 476 forms an angle that is less than or greater than 90 degrees with respect to the central axis of the instrument. This configuration of the tailpiece adjustment mechanism 410 will also generally suffice to alter an acoustic property of the stringed instrument.

Dimensions of tailpiece adjustment mechanism 410 shown in FIGS. 26-29—such as thickness 480, width 482, and height 484—are not limited and may be readily determined by one of ordinary skill in the art based on the type and dimensions of a particular stringed instrument. For example, as shown in FIGS. 27 and 29 for a stringed instrument 86 in the violin family, the thickness 480 of bridging element 412 may approximate the thickest portion of bridge 478, although other thicknesses may likewise be used. Increasing the thickness 480 of bridging element 412 beyond the thickness of a conventional bridge may increase the stability of the tailpiece adjustment mechanism 410 when it is positioned under a tailpiece in an upright position. In addition, for instruments in the violin family, the width 482 of bridging element 412 may approximate the widest portion of the bridge although other widths may likewise be used. It is presently preferable that the width 482 of bridging element 412 be at least as wide as the width of the broad top edge of the tailpiece, such that the bridging element 412 will be able to contact both sides of the tailpiece regardless of whether it is positioned in a bottom, middle or top portion thereof.

The shape of bridging element 412 is not limited and may include all manner of regular or irregular geometric shapes that may be used to rotate at least a portion of a tailpiece in accordance with the present invention. A presently preferred shape for bridging elements in accordance with the above-described presently preferred embodiments is a U-shape, as shown in FIGS. 28 and 30.

To alter an acoustic property of a stringed instrument using the tailpiece adjustment mechanism 410 shown in FIGS. 26-29, the bridging element 412 is positioned in an upright position underneath a tailpiece 430 such that one side of tailpiece 430 (i.e., either first side 428 or second side 436) is positioned in notch 426 in the interior surface 424 of first stanchion 420, and the other side is positioned in notch 434 in the interior surface 432 of second stanchion 422, or vice versa. Similarly, to alter an acoustic property of a stringed instrument using the tailpiece adjustment mechanism 454 shown in FIG. 30, the bridging element is positioned in an upright position underneath a tailpiece, such that one side of the tailpiece 430 is positioned in either of first notch 460 or second notch 462, and the other side is positioned in either of first notch 468 or second notch 470, or vice versa. It should be noted that by turning certain embodiments of tailpiece adjustment mechanisms 410 and 454 by 180 degrees relative to their original configurations, a portion of a tailpiece that had been elevated in a prior configuration may instead be lowered, or vice versa.

As described above in connection with other presently preferred embodiments, it is presently preferred, particularly for stringed instruments in the violin family, that a tailpiece be positioned in the tailpiece adjustment mechanisms shown in FIGS. 26-30 such that the weaker side of an instrument may be strengthened thereby. For example, to use the tailpiece adjustment mechanism 454 shown in FIG. 30 to strengthen the G-string side or bass side of a violin, the side of the tailpiece closest to the treble side may be positioned in second notch 462 and the side of the tailpiece closest to the bass side may be positioned in first notch 468. In such a configuration, the side of the tailpiece closest to the treble side will be elevated, thereby increasing the pressure on the bass side of the instrument.

In accordance with the present invention, as noted above, it has been discovered that immobilization of at least a portion of a tailpiece may result in a reduction in the vibrations it produces when a stringed instrument containing the immobilized tailpiece is played. It has further been discovered that this type of immobilization serves to alter an acoustic property of the stringed instrument inasmuch as the strength and/or volume of sound produced by the stringed instrument is generally greater when the tailpiece is at least partially immobilized as compared to the conventional situation wherein the tailpiece may vibrate freely.

In view of these discoveries, devices for altering an acoustic property of a stringed instrument embodying features of the present invention include a tailpiece adjustment mechanism configured for (a) immobilizing at least a portion of a tailpiece such that at least a portion of vibrations of the tailpiece are restrained when the stringed instrument is played, and/or for (b) rotating at least a portion of the tailpiece relative to a central axis of the stringed instrument.

It has been discovered that the alteration in acoustic properties of a stringed instrument resulting from immobilization of a tailpiece is typically greater when a portion of the tailpiece near the broad top edge (i.e., near the string receiving holes) is immobilized as compared to when a portion of the tailpiece near the narrow bottom edge is immobilized. Thus, when immobilization of a tailpiece is desired by a user, it is presently preferred that a tailpiece adjustment mechanism embodying features of the present invention be configured for immobilizing at least a portion of the tailpiece near the string receiving holes therein.

A representative tailpiece adjustment mechanism configured for immobilizing at least a portion of a tailpiece which, as described above, may optionally be further configured for rotating at least a portion of the tailpiece relative to a central axis of the stringed instrument, includes certain configurations of the tailpiece adjustment mechanisms 410 and 454 shown in FIGS. 26-29 and FIG. 30, respectively. For example, when the distances 440 and 446 shown in FIG. 28 are substantially equal in magnitude and are substantially equal to an "ambient distance" between the top surface 84 of stringed instrument 86 and a bottom surface 438 of tailpiece 430, at least a portion of a tailpiece positioned in notches 426 and 434 will be immobilized without being substantially rotated.

Alternative mechanisms for immobilizing a tailpiece in accordance with the present invention include restraining the tailpiece with one or more strings, cords or threads and/or with one or more elastomeric members (e.g., polymeric films, such as polyurethane; stretchable fabrics, such as spandex; elastic loops, such as natural or synthetic rubber bands; and the like). By way of example, a rubber band looped, wrapped or knotted around the tailpiece, preferably near the broad top edge thereof, and secured to opposite corners of the stringed instrument (e.g., a violin) will typically suffice to restrain at least a portion of the vibrations of the tailpiece and, therefore, may be employed in accordance with the present invention.

In accordance with the present invention, as noted above, it has been discovered that one or more acoustic properties of a stringed instrument may be altered by transmitting at least a portion of the vibrations produced in the tailpiece when the stringed instrument is played into the body of the stringed instrument. It has further been discovered that such transmission of tailpiece vibrations into at least a portion of the body serves to alter an acoustic property of the stringed instrument inasmuch as the strength and/or volume of sound produced by the stringed instrument may be increased.

In view of these discoveries, devices for altering an acoustic property of a stringed instrument embodying features of the present invention include a tailpiece adjustment mechanism configured for (a) transmitting at least a portion of the vibrations produced in the tailpiece when the stringed instrument is played into the body of the stringed instrument, and/or for (b) immobilizing at least a portion of a tailpiece such that at least a portion of vibrations of the tailpiece are restrained when the stringed instrument is played, and/or for (c) rotating at least a portion of the tailpiece relative to a central axis of the stringed instrument.

Tailpiece adjustment mechanisms configured for transmitting at least a portion of the vibrations produced in the tailpiece when the stringed instrument is played into a body portion of the stringed instrument include at least one connecting element positioned between and in contact with the tailpiece (e.g., a bottom surface thereof and the stringed instrument (e.g., a top surface thereof. In this configuration, vibrations in the tailpiece may be communicated through the connecting element and into one or more sounding portions of the stringed instrument. By way of example, for instruments in the violin family, such sounding portions include but are not limited to one or more of wooden surfaces or components, such as the top surface, the bottom surface, the bass bar, the soundpost, the ribs or the like.

Representative tailpiece adjustment mechanisms configured for transmitting at least a portion of the vibrations produced in the tailpiece when the stringed instrument is played into a body portion of the stringed instrument—which may optionally be further configured for (a) immobilizing at least a portion of the tailpiece such that at least a portion of vibrations of the tailpiece are restrained when the stringed instrument is played and/or for (b) rotating at least a portion of the tailpiece relative to a central axis of the stringed instrument—include certain configurations of the tailpiece adjustment mechanisms 370, 398, and 404 shown in FIGS. 23-25, respectively, the tailpiece adjustment mechanism 410 shown in FIGS. 26-29, and the tailpiece adjustment mechanism 454 shown in FIG. 30. Each of these tailpiece adjustment mechanisms includes at least one connecting element configured to be positioned between a bottom surface of the tailpiece and a top surface of the stringed instrument, which provides a channel through which vibrations may be transmitted (i.e., from the tailpiece through the connecting element, and into the stringed instrument).

A further representative tailpiece adjustment mechanism configured for transmitting vibrations as described above includes a modification of the tailpiece adjustment mechanism 370 shown in FIG. 23. In this modification, the tailpiece adjusting side 374 of bridging element 372 is substantially level as opposed to slanted (i.e., the distance between supporting side 376 and second end 380 is substantially equal to the distance between supporting side 376 and first end 378). In this arrangement, the tailpiece adjustment mechanism 370 will be configured to contact a bottom surface of the tailpiece (e.g., at one of the typically flat and uncurved bottom or middle portions thereof) along substantially the entire width of the tailpiece. Depending on the height 396 of bridging element 372, the substantially level tailpiece adjusting side 374 may or may not substantially raise the tailpiece. Nonetheless, this modification of tailpiece adjustment mechanism 370 provides a suitable connecting element for communicating vibrations of the tailpiece into the stringed instrument.

All manner of materials are contemplated for the construction of the above-described vibration-transmitting tailpiece adjustment mechanisms, including but not limited to wood, metal (e.g., gold, silver, copper, etc.), metal alloys (e.g., brass, bronze, etc.), plastic, and the like, and combinations thereof. However, inasmuch as the connecting element of these tailpiece adjustment mechanisms is positioned between the tailpiece and the stringed instrument, such that the connecting element receives at least a portion of the vibrations emanating from the tailpiece and transfers at least a portion of these received vibrations into the stringed instrument, it is presently preferred that a material be used that allows minimal quelling of the vibrations received. Metals are presently preferred materials, with gold being a particularly preferred metal at present. Moreover, the above-described vibration-transmitting tailpiece adjustment mechanisms may be formed such that they are either solid or hollow on the inside.

In the presently preferred embodiments described above, the tailpiece adjustment mechanisms embodying features of the present invention operate according to mechanical principles. However, the present invention is not limited thereto. Alternative tailpiece adjustment mechanisms, for example mechanisms that are controlled electrically, pneumatically, hydraulically or by equivalent principles, are contemplated for use and lie within the scope of the present invention.

Devices for altering an acoustic property of a stringed instrument in accordance with the present invention also include automated devices, such as those including a controller and/or an adjusting logic (e.g., a height adjusting logic). Automated devices contemplated for use in accordance with the present invention include an automated tailpiece adjustment mechanism and, optionally, an automated acoustic detecting mechanism. The automated acoustic detecting mechanism is configured to compare an acoustic property (e.g., pitch) of one or more open strings of a stringed instrument (i.e., strings prior to placement of a player's finger) and/or one or more musical notes as played by a player with pre-stored reference frequencies. When the automated acoustic detecting mechanism determines that a particular acoustic property needs adjustment in accordance with pre-set guidelines (e.g., the pitch of an open string should be maintained within a pre-set range or at a pre-set value), the tailpiece adjustment mechanism automatically rotates at least a portion of a tailpiece relative to the central axis of the stringed instrument until the target altered acoustic property is achieved.

The presently preferred embodiments of devices in accordance with the present invention described herein may be used in all manner of stringed instruments having a tailpiece or an analogue thereof. Analogues of a tailpiece include any portion of an instrument, or any accessory added thereto, that secures one of the ends of at least one string. Representative stringed instruments for use in accordance with and/or embodying features of the present invention include but are not limited to those in the violin family (e.g., violins, violas, cellos, and double basses) and variations thereof. Although it is presently preferred that the stringed instruments used in accordance with and/or embodying features of the present invention contain at least one of a soundpost, bass bar, and bridge, the present invention may also be used with stringed instruments lacking such elements. Provided an instrument contains at least one string extended between two distal points, the present invention may be used to alter an acoustic property of the instrument (e.g., by altering the effective length of a string).

For stringed instruments that are to be held under the chin of a player, such as a violin or a viola, the location of a tailpiece adjustment mechanism embodying features of the present invention may be varied to accommodate the style of chinrest preferred by the player. As shown in FIG. 1, the chinrest 62 is a supportive plate configured to receive a player's chin, which is attached at the bottom edge 56 of violin 2, typically on the bass side 44 adjacent to tailpiece 30. Some designs of chinrests (e.g., Guarneri, Strad, PVS, Flesch, Vermeer, Teka, Kaufman, Dresden, Morawetz, London, Stuber, etc.) extend partially or completely over the narrow bottom edge 48 of the tailpiece 30 shown in FIG. 1. To accommodate such designs, a tailpiece adjustment mechanism embodying features of the present invention may be located in a portion of the tailpiece that provides unrestricted access to the tailpiece adjustment mechanism and/or to an adjustable member thereof (e.g., by locating the tailpiece adjustment mechanism away from the narrow bottom edge 48 shown in FIG. 1). Moreover, for a chinrest design that extends only partially over the tailpiece on the bass side of the stringed instrument, it may still be preferable to position a tailpiece adjustment mechanism embodying features of the present invention near the narrow bottom edge 48 of the tailpiece 30 shown in FIG. 1 (e.g., as in the above-described presently preferred devices shown in FIGS. 6, 9, and 21). If this is the case, it may be preferable to use a tailpiece adjustment mechanism that includes only one adjustable member (e.g., a screw) at the bottom edge 48 shown in FIG. 1, which adjustable member is preferably positioned on the treble side of the instrument.

As will be appreciated by those of ordinary skill in the art, the dimensions of the component parts in a tailpiece adjustment mechanism embodying features of the present invention are selected based on the dimensions of a particular stringed instrument. By way of illustration, each of the above-described presently preferred embodiments can be used to alter the acoustic property of a violin, a viola, a cello or a double bass. However, inasmuch as the dimensions of these instruments increase in size ranging from the smallest (the violin) to the largest (the double bass), the dimensions of the tailpiece adjustment mechanisms should increase accordingly.

For example, the distance between the top surface of an instrument and its tailpiece is larger for a double bass than for a violin. Thus, by way of illustration, if the stringed instrument 86 shown in FIGS. 2, 6, 9, 14, 17, and 21 corresponds to a double bass, the component parts of the corresponding tailpiece mechanisms shown in the drawings will be larger than they would be in the case of a violin. For example, the lengths of first screw 68 and second screw 108 included in the first presently preferred embodiment shown in FIG. 2 will be larger for a double bass than for a violin as a result of the larger distance between the top surface of a double bass and its tailpiece as compared to a violin. In addition, for larger instruments such as the double bass, it may be preferable to utilize screws having a thicker shank as compared to screws used with smaller instruments such as the violin.

The degree to which at least a portion of a tailpiece is rotated to alter an acoustic property in accordance with the present invention is not restricted, and may vary according to (a) the type of acoustic property to be altered, (b) the extent to which a change in acoustic property is desired, and (c) the dimensions of a particular stringed instrument. Solely by way of illustration, for instruments in the violin family, representative presently preferred rotations that may be useful for altering acoustic properties thereof include but are not limited to rotations of about 1, about 2, about 3, about 4, about 5, about 6, about 7, about 8, about 9, about 10, about 11, about 12, about 13, about 14, about 15, about 16, about 17, about 18, about 19, and about 20 degrees. Representative presently preferred rotations likewise include but are not limited to all fractions of these degrees and all intervals therebetween. Of course, larger degrees of rotation may be more desirable and/or more practically feasible for larger instruments (e.g., double basses) as compared to smaller instruments (e.g., violins).

A stringed instrument embodying features of the present invention includes a tailpiece adjustment mechanism of a type described herein. A presently preferred stringed instrument embodying features of the present invention includes a tailpiece adjustment mechanism configured for adjusting a distance between a top surface of the stringed instrument and at least a portion of a tailpiece, such that a change in the distance causes a rotation of at least a portion of the tailpiece relative to a central axis of the stringed instrument. Representative tailpiece adjustment mechanisms for inclusion in the stringed instrument include but are not limited to the presently preferred embodiments described above.

A first method for altering an acoustic property of a stringed instrument embodying features of the present invention includes rotating at least a portion of a tailpiece relative to a central axis of the stringed instrument, thereby producing an altered acoustic property. The altered acoustic property produced in accordance with the present invention is substantially constant in that it may be controlled by an operator subject to a minimum of unintended and/or adventitious fluctuations. Methods embodying features of the present invention preferably further include altering a pressure applied to at least one of a bridge, a soundpost, and a bass bar and/or altering an effective length of at least one string.

A second method for altering an acoustic property of a stringed instrument embodying features of the present invention includes immobilizing at least a portion of a tailpiece such that at least a portion of vibrations of the tailpiece are restrained when the stringed instrument is played. Preferably, the altered acoustic property produced in accordance with the present invention is substantially constant, as described above.

Immobilization of a tailpiece in accordance with methods embodying features of the present invention may be achieved by using a device embodying features of the present invention, such as the representative presently preferred embodiments described above, or by one of the representative alternative mechanisms, such as those described above.

A third method for altering an acoustic property of a stringed instrument embodying features of the present invention includes transmitting at least a portion of vibrations produced in a tailpiece when the stringed instrument is played into a body portion of the stringed instrument.

Transmission of vibrations in accordance with methods embodying features of the present invention may be achieved by using a device embodying features of the present invention, such as the representative presently preferred embodiments described above, or by one of the representative alternative mechanisms, such as those described above.

The foregoing detailed description and accompanying drawings have been provided by way of explanation and illustration, and are not intended to limit the scope of the appended claims or their equivalents. Many variations in the presently preferred embodiments illustrated herein will be obvious to one of ordinary skill in the art, and remain within the scope of the appended claims and their equivalents.

The invention claimed is:

1. A device for altering an acoustic property of a stringed instrument comprising:

a bridging element comprising at least a first portion configured for contacting a bottom surface of a tailpiece of the stringed instrument, and at least a second portion configured for contacting a top surface of the stringed instrument;

wherein the first portion comprises a tailpiece adjusting side and the second portion comprises a supporting side;

wherein no part of the supporting side extends into the top surface of the stringed instrument;

wherein the bridging element is configured for longitudinal movement along a central axis of the stringed instrument; and wherein the stringed instrument is selected from the group consisting of a violin, a viola, a cello, and a double bass.

2. The invention of claim 1 wherein the supporting side is contoured to the top surface of the stringed instrument.

3. The invention of claim 1 further comprising a protecting member connected to a lower surface of the supporting side, wherein the protecting member is configured to contact the top surface of the stringed instrument.

4. The invention of claim 3 wherein the protecting member comprises cork.

5. The invention of claim 1 wherein the bridging element comprises a prism shape.

6. The invention of claim 1 wherein the bridging element comprises a quadrilateral prism shape.

7. The invention of claim 1 wherein the tailpiece adjusting side is slanted and comprises a tailpiece elevating end.

8. The invention of claim 1 wherein the tailpiece adjusting side is substantially level.

9. The invention of claim 8 wherein a height of the bridging element is larger than an ambient distance between the top surface of the stringed instrument and the bottom surface of the tailpiece.

10. The invention of claim 8 wherein a height of the bridging element is substantially equal to an ambient distance between the top surface of the stringed instrument and the bottom surface of the tailpiece.

11. The invention of claim 1 wherein a width of the tailpiece adjusting side is substantially equal to a width of the tailpiece at a portion thereof configured for contacting the tailpiece adjusting side.

12. The invention of claim 1 wherein the bridging element comprises a material selected from the group consisting of gold, silver, copper, wood, and combinations thereof.

13. The invention of claim 1 wherein the bridging element comprises a material selected from the group consisting of gold, ebony, rosewood, boxwood, ivory, and combinations thereof.

14. The invention of claim 13 wherein the bridging element comprises a solid interior.

15. The invention of claim 13 wherein the bridging element comprises a hollow interior.

16. The invention of claim 1 wherein the stringed instrument is selected from the group consisting of a violin, a viola, and a cello.

17. The invention of claim 1 wherein the stringed instrument is selected from the group consisting of a violin and a viola.

18. The invention of claim 1 wherein the stringed instrument comprises a violin.

19. A device for altering an acoustic property of a stringed instrument comprising:

a prism-shaped bridging element comprising a tailpiece adjusting side and a supporting side, wherein at least a portion of the bridging element is configured for placement underneath a tailpiece of the stringed instrument, wherein at least a portion of the tailpiece adjusting side is configured for contacting a bottom surface of the tailpiece, and wherein at least a portion of the supporting side is configured for contacting a top surface of the stringed instrument; and a protecting member connected to a lower surface of the supporting side;

wherein the tailpiece adjusting side is substantially level;

wherein the bridging element comprises a material selected from the group consisting of gold, silver, copper, ebony, rosewood, boxwood, ivory, and combinations thereof; and wherein the stringed instrument is selected from the group consisting of a violin, a viola, a cello, and a double bass.

20. A method for altering an acoustic property of a stringed instrument comprising:

transmitting at least a portion of vibrations produced in a tailpiece when the stringed instrument is played through a connecting element into a body portion of the stringed instrument;

wherein at least a first portion of the connecting element is in contact with a bottom surface of the tailpiece and wherein at least a second portion of the connecting element is in contact with a top surface of the stringed instrument;

wherein the first portion comprises a tailpiece adjusting side and the second portion comprises a supporting side;

wherein no part of the supporting side extends into the top surface of the stringed instrument;

wherein the connecting element is configured for longitudinal movement along a central axis of the stringed instrument; and wherein the stringed instrument is selected from the group consisting of a violin, a viola, a cello, and a double bass.

* * * * *